US010500132B2

(12) United States Patent
Py

(10) Patent No.: US 10,500,132 B2
(45) Date of Patent: Dec. 10, 2019

(54) POUCH WITH SEALED FITMENT AND METHOD

(71) Applicant: Dr. Py Institute, LLC, New Milford, CT (US)

(72) Inventor: Daniel Py, Larchmont, NY (US)

(73) Assignee: DR. PY INSTITTUE, LLC, New Milford, CT (US)

( * ) Notice: Subject to any disclaimer, the term of this patent is extended or adjusted under 35 U.S.C. 154(b) by 71 days.

(21) Appl. No.: 14/990,778

(22) Filed: Jan. 7, 2016

(65) Prior Publication Data

US 2016/0199258 A1 Jul. 14, 2016

Related U.S. Application Data

(60) Provisional application No. 62/100,725, filed on Jan. 7, 2015.

(51) Int. Cl.
*A61J 1/10* (2006.01)
*A61J 1/14* (2006.01)

(52) U.S. Cl.
CPC ..... *A61J 1/10* (2013.01); *A61J 1/1481* (2015.05); *A61J 1/1487* (2015.05); *A61J 1/1406* (2013.01); *A61J 1/1493* (2013.01)

(58) Field of Classification Search
CPC ..... A61J 1/2048; A61J 1/1481; A61J 1/1487; A61J 1/10; A61J 1/1406
See application file for complete search history.

(56) References Cited

U.S. PATENT DOCUMENTS 4,147,827 A 4/1979 Breidt, Jr. et al.
4,394,936 A 7/1983 Shavit
5,006,118 A * 4/1991 Yule ..... A61J 1/067 128/DIG. 24
5,193,913 A 3/1993 Rosenbaum
(Continued)

FOREIGN PATENT DOCUMENTS

EP 0734709 A2 10/1996
WO 97/36785 A1 10/1997

OTHER PUBLICATIONS

International Search Report and Written Opinion dated Mar. 11, 2016, for International Application No. PCT/US2016/012552. 10 pages.

(Continued)

*Primary Examiner* — Philip R Wiest
(74) *Attorney, Agent, or Firm* — McCarter & English, LLP

(57) ABSTRACT

A pouch comprises a film including (i) a fold defining a fold plane and a first marginal edge portion of the pouch, (ii) a first side transverse to the fold plane, and (iii) a second side opposite the first side and transverse to the fold plane. A fitment of the pouch includes a port and a base. The base defines a mid-portion engaging the fold at the fold plane, a first side located on one side of the mid-portion, and a second side located on an opposite side of the mid-portion relative to the first side. The first and second sides of the base are transverse to the fold plane, and are engaged with the first or second sides of the film, respectively. The base or film overlaps the other and defines an overlapping region. The base and film are sealed to each other within the overlapping region and form a fluid-tight seal that extends about the port.

52 Claims, 25 Drawing Sheets

(56) References Cited

U.S. PATENT DOCUMENTS

| | | | | |
|---|---|---|---|---|
| 5,307,955 | A | 5/1994 | Viegas | |
| 5,334,180 | A * | 8/1994 | Adolf | A61J 1/05 222/81 |
| 5,600,933 | A | 2/1997 | Wiles et al. | |
| 5,642,538 | A | 7/1997 | Richmond | |
| 6,007,529 | A | 12/1999 | Gustafsson et al. | |
| 6,394,993 | B1 * | 5/2002 | Chang | A61J 1/10 128/DIG. 24 |
| 6,996,951 | B2 | 2/2006 | Smith et al. | |
| 7,527,619 | B2 | 5/2009 | Domkowski et al. | |
| 7,954,521 | B2 | 6/2011 | Py et al. | |
| 8,136,330 | B2 | 3/2012 | Ostler et al. | |
| 8,734,396 | B2 | 5/2014 | Wyss | |
| 8,926,923 | B2 | 1/2015 | Blomberg | |
| 9,023,009 | B2 | 5/2015 | Wyss et al. | |
| 2004/0222224 | A1 | 11/2004 | Plester | |
| 2005/0059952 | A1 * | 3/2005 | Giuliano | A61J 1/10 604/408 |
| 2006/0037884 | A1 | 2/2006 | Doyle et al. | |
| 2007/0060902 | A1 * | 3/2007 | Brandenburger | A61J 1/10 604/403 |
| 2011/0027507 | A1 | 2/2011 | Mileti | |
| 2011/0027508 | A1 | 2/2011 | Mileti | |
| 2013/0008137 | A1 | 1/2013 | Py | |
| 2013/0146227 | A1 | 6/2013 | Mileti | |
| 2013/0180618 | A1 | 7/2013 | Py | |
| 2013/0270820 | A1 | 10/2013 | Py | |
| 2013/0292592 | A1 | 11/2013 | Py | |
| 2014/0001180 | A1 * | 1/2014 | Gage | B65D 75/5872 220/62.12 |
| 2014/0263147 | A1 | 9/2014 | Py | |
| 2014/0311617 | A1 | 10/2014 | Py | |

OTHER PUBLICATIONS

Supplementary Partial European Search Report dated Nov. 14, 2018 for European Patent Application EP16735439.8, 1 page.

* cited by examiner

POUCH WITH SEALED FITMENT AND METHOD

CROSS-REFERENCE TO PRIORITY APPLICATION

This patent application claims priority under 35 U.S.C. § 119 to U.S. provisional patent application Ser. No. 62/100,725, filed 7 Jan. 2015, entitled "Pouch With Sealed Fitment And Method," which is hereby expressly incorporated by reference in its entirety as part of the present disclosure.

FIELD OF THE INVENTION

The present invention relates to devices, such as flexible pouches, defining therein chambers, and including fitments for sterile filling substances into the chambers, and more particularly, to such devices formed of films, and to fitments that are sealed to the films.

BACKGROUND INFORMATION

A typical pouch is shown in FIGS. 1 through 4 and indicated generally by the reference numeral 1. The pouch 1 is made of opposing sheets of plastic film 2, 3 that are sealed to each other, such as by heat sealing, along their marginal edge portions to define an internal chamber 4 therebetween. The pouch 1 includes a port defined by a rigid tube or outflow fitment 5 that is sealed between the opposing marginal edges of the films 2, 3. The rigid tube 5 includes a closure (not shown) to seal the internal chamber 4 from the ambient atmosphere.

One of the drawbacks of such pouches, especially those that hang to deliver products to patients, need to be consecutively connected to tubing, and/or need to be fully emptied, is that the outflow fitment is somewhat circular and has to be sealed in between the front and back sheets of the pouch. Accordingly, it can be difficult to obtain a fluid-tight and/or a gas-tight seal at the junction of the opposing marginal edge portions of the films 2,3 and the rigid tube or outflow fitment 5. These junctions are located at diametrically opposite sides of the tube 5, involve the intersection of three components and materials, and present a risk of forming a leak at one or both of these junctions at the time of manufacture or thereafter. Leakage at the pouch/tubing junction can be the most frequent source of leakage in hanging pouches. In order to avoid the creation of such leaks, the sealing fixture must be precisely aligned. Such leaks can be formed by extremely tiny holes defining diameters in the micron range, and therefore can be difficult to detect with typical quality control tests, such as burst pressure or helium detection tests. Yet another drawback of such pouches and other prior art pouches is that the fitments are sealed to the pouches at the edge portions, but the fitments do not extend contiguous with, and are not sealed to the side walls of the pouches spaced away from the edge portions. This further reduces the integrity of the seals, and the ability to prevent leakage.

It is an object of the present invention to overcome one or more of the above-described drawbacks and/or disadvantages.

SUMMARY OF THE INVENTION

In accordance with a first aspect, the present invention is directed to a pouch comprising a film including (i) a fold defining a fold plane and a first marginal edge portion of the pouch, (ii) a first side transverse to the fold plane, and (iii) a second side opposite the first side and transverse to the fold plane. A fitment of the pouch includes a port and a base. The base defines a mid-portion engaging the fold at the fold plane, a first side located on one side of the mid-portion, and a second side located on an opposite side of the mid-portion relative to the first side. The first and/or second side of the base is transverse to the fold plane, and is engaged with the first or second side of the film, respectively. The base or film overlaps the other and defines an overlapping region. The base and film are sealed to each other within the overlapping region and form a fluid-tight seal that extends about the port.

In some embodiments of the present invention, the first side of the base is located on one side of, and is transverse to the fold plane, and is engaged with the first side of the film, and the second side of the base is located on one side of, and is transverse to the fold plane, and is engaged with the second side of the film. In some embodiments, the mid-portion of the base defines a first width, the first and second sides of the base each define a respective width that is at least a second width, and the second width is at least about 1½ times the first width. In some such embodiments, the second width is at least about 3 times the first width.

In some embodiments of the present invention, the mid-portion of the base intersects the fold plane and/or is substantially parallel to the fold plane. In some such embodiments, the first and second sides of the base are each located on one side of the fold plane and oriented at a respective acute angle relative to the fold plane. In some such embodiments, the acute angle is within the range of greater than about 45° to less than about 90°.

In some embodiments of the present invention, either (i) the film overlaps the mid-portion and first and second sides of the base in the overlapping region, or (ii) the mid-portion and first and second sides of the base overlap the film in the overlapping region. In some embodiments, the film includes a plurality of layers, at least one layer is different than at least one other layer, and the base and film each include a common material in contact with the other in the overlapping region. In some such embodiments, the base and the film are heat sealed to each other in the overlapping region. Preferably, the base and film are sealed to each other along a perimeter seal extending along or about the perimeter of the port. In some embodiments, the base and film are sealed to each other substantially throughout the overlapping region and define a single seal interface. In some embodiments, the base and film are sealed to each other throughout a perimeter seal in the overlapping region that surrounds the port. Preferably, the base and film are sealed to each other throughout a continuous, uninterrupted, substantially contiguous, single interface between the base and film that extends annularly about the port. Preferably, the single interface seal extends across the mid-portion and each of the first and second sides of the base.

In some embodiments of the present invention, (i) a plurality of opposing edges of the film are sealed to each other to thereby define a sealed pouch including a chamber therein; and (ii) the pouch defines a second marginal edge portion located on an opposite side of the pouch relative to the first marginal edge portion, a third marginal edge portion extending between the first and second marginal edge portions, and a fourth marginal edge portion located on an opposite side of the pouch relative to the third marginal edge portion. In some such embodiments, the second, third and fourth marginal edge portions each are defined by sealed opposing marginal edge portions of the film. Preferably, each pouch is formed of a single sheet of film.

In some embodiments of the present invention, the fitment includes a boss defining the port and extending outwardly from the base. In some such embodiments, the fitment includes at least one of (i) a penetrable and resealable septum and (ii) a sterile connector. In some embodiments, (i) the pouch defines a sealed chamber, (ii) the penetrable and resealable septum is penetrable by a needle or like injection member to fill the chamber of the pouch with a substance, and the resulting penetration aperture in the septum is resealable by the application of at least one of heat, radiation, chemical sealant, or mechanical seal thereto; and (iii) the sterile connector includes a penetrable septum that seals the chamber with respect to ambient atmosphere.

In some embodiments of the present invention, the pouch defines a sealed chamber, and the fitment includes a first fitting and a second fitting. In some such embodiments, the first fitting defines a first port for filling a substance into the chamber, and the second fitting defines a second port for dispensing or extracting substance from the chamber. In some such embodiments, the first fitting forms a fluid-tight seal between the chamber and ambient atmosphere and is configured to fill a substance through the first port and into the chamber, and the second port forms a fluid-tight seal between the chamber and ambient atmosphere. In some embodiments, (i) the first fitting includes a septum that is penetrable by a needle or like injection member, or a normally-closed filling valve, and (ii) the second port includes a septum that is penetrable by a needle or like injection member, or a normally-closed dispensing or withdrawal valve.

In some embodiments, the dispensing or withdrawal valve includes a normally-closed valve (i) that is engageable by a device, such as a syringe, to open the valve and dispense, extract or otherwise withdraw substance from the pouch chamber, and (ii) is closed by disengaging the device from the valve to maintain a fluid-tight seal between the pouch chamber and ambient atmosphere. In some such embodiments, (i) the valve includes a valve member, a valve seat, and a spring that normally biases the valve member into engagement with the valve seat to close the valve, (ii) the valve member is engageable by the device to move the valve member away from the valve seat against the bias of the spring to open the valve, and (iii) the spring biases the valve member into engagement with the valve seat to the close the valve when the device is disengaged from the valve member. In some such embodiments, the spring is an elastic spring defining a least one aperture in fluid communication with the pouch chamber to allow fluid to flow from the pouch chamber through the aperture and open valve.

In accordance with another aspect, the present invention is directed to a pouch comprising a film including a fold defining a fold plane and forming a first marginal edge portion of the pouch. A first side of the pouch is located on one side of the fold and is transverse to the fold plane. A second side of the pouch is located opposite the first side of the pouch and is transverse to the fold plane. A chamber is formed between the first and second sides of the pouch. A fitment of the pouch includes (i) first means for at least one of introducing a substance into the chamber or withdrawing a substance from the chamber; (ii) second means for engaging the fold at the fold plane; (iii) third means located on one side of the second means for engaging the first side of the pouch; (iv) fourth means located on an opposite side of the second means relative to the third means and for engaging the second side of the pouch; and (v) fifth means for forming a continuous, uninterrupted, single interface seal between the fitment and pouch that extends annularly about the first means.

In some embodiments of the present invention, (i) the first means is a port, (ii) the second means is a mid-portion of a base of the fitment, (iii) the third means is one side of the base of the fitment located on one side of the mid-portion, (iv) the fourth means is another side of the base of the fitment located on an opposite side of the base relative to third means, and (v) the fifth means is a heat sealed, overlapping region of the film and base extending across the fold, the first side and the second side of the pouch. In some such embodiments, the first side of the base is located on one side of, and is transverse to the fold plane, and is engaged with the first side of the pouch, and the second side of the base is located on one side of, and is transverse to the fold plane, and is engaged with the second side of the pouch.

In some embodiments of the present invention, the fitment includes (i) sixth means for sterile filling the pouch with a substance; and (ii) seventh means for connecting to the pouch in sterile fluid communication with the chamber and withdrawing or dispensing substance therefrom. In some such embodiments, the sixth means (i) is a penetrable and resealable septum that is penetrable by a needle or like injection member to fill the chamber of the pouch with a substance, and the resulting penetration aperture in the septum is resealable by the application of at least one of heat, radiation, chemical sealant, or mechanical seal thereto, or (ii) is a filling valve including a valve member normally biased by a spring into engagement with a valve seat to close the valve, and engageable by a filling member to depress the valve member against the bias of the spring, open the valve, and introduce the substance from the filling member through the open valve; and the seventh means (i) is a sterile connector including a penetrable septum that seals the chamber with respect to ambient atmosphere, or (ii) is a sterile connector including a valve member normally biased by a spring into engagement with a valve seat to close the valve.

In accordance with another aspect, the present invention is directed to a method comprising the following steps:

(i) overlapping a mid-portion of a fitment base and a fold of a film with the other at a fold plane;

(ii) overlapping a first side of the fitment base located on a first side of the mid-portion thereof and a first side of the film with the other;

(iii) overlapping a second side of the fitment base located on a second side thereof and a second side of the film with the other, wherein at least one of the first or second sides of the base is transverse to the fold plane and is engaged with the first or second side of the film, respectively;

(iv) sealing a plurality of opposing marginal edge portions of the film and forming a sealed empty chamber therein; and (v) forming a continuous, uninterrupted, single interface seal that extends between the fold and the mid-portion of the fitment base, extends between the first side of the fitment base and the first side of the film, and extends between the second side of the fitment base and the second side of the film.

In some embodiments of the present invention, the first side of the base is transverse to the fold plane and is engaged with the first side of the film, and the second side of the base is transverse to the fold plane and is engaged with the second side of the film. In some embodiments of the present invention, the method further comprises (i) overlapping the film to the fitment base, or (ii) overlapping the fitment base to the film. In some embodiments of the present invention, steps (i) through (iii) are performed substantially simultaneously. In some embodiments of the present invention, step (iv) is performed prior to steps (i) through (iii). Some embodiments of the present invention further comprise (i) folding the film after sealing the film and fitment base to each other, or (ii) folding the film before sealing the film and fitment base to each other.

Some embodiments further comprise (i) sealing the plurality of opposing marginal edge portions of the film, and forming a sealed empty chamber therein prior to sealing the film and fitment base to each other, or (ii) sealing the plurality of opposing marginal edge portions of the film, and forming a sealed empty chamber therein after sealing the film and fitment base to each other. Some embodiments of the present invention comprise heat sealing the film and fitment base to each other. Some embodiments of the present invention further comprise forming an aperture in the film, and sealing the film and fitment base to each other at a single sealed interface extending about a perimeter of the aperture.

Some embodiments of the present invention further comprise attaching to the film a fitment including at least one of (i) a penetrable and resealable septum, or (ii) a sterile connector. In some such embodiments, the penetrable and resealable septum is penetrable by a needle or like injection member to fill the chamber of the pouch with a substance, and the resulting penetration aperture in the septum is resealable by the application of at least one of heat, radiation, chemical sealant, or mechanical seal thereto.

Some embodiments of the present invention further comprise molding the fitment with a plurality of sprouts, wherein at least one sprout is configured for filling a substance into the pouch, and another sprout is configured for dispensing substance from the pouch. Some such embodiments further comprise molding the fitment with a single sprout including a valve for at least one of filling a substance through the valve and into the pouch, or dispensing a substance through the valve and from the pouch. Some embodiments of the present invention further comprise molding the fitment with a plurality of sprouts, wherein a first sprout includes a luer connector including a valve therein for connecting a syringe thereto and withdrawing substance from the pouch through the valve and into the syringe, and a second sprout is configured for filling substance into the pouch.

Some embodiments of the present invention further comprise introducing a fluid sterilant, such as nitric oxide or ozone, into the interior of the pouch to sterilize the pouch. Some such embodiments further comprise molding a fitment with a sprout including a penetrable and self-resealing septum, penetrating the septum with a needle or like injection member, introducing the fluid sterilant through the needle or like injection member and into the pouch, withdrawing the needle, and allowing the septum to reseal itself and retain fluid sterilant in the pouch for a period of time sufficient to sterilize the interior of the pouch.

One advantage of the present invention is that the port is sealed to the film at the base of the fitment where the base and film overlap one another thereby defining a single, sealed interface between the fitment and the film. The single interface seal may extend about the perimeter of the port and may be defined by the interface of only two components and/or materials. As a result, the three-component and material junctures of the above-described pouches, and their associated leakage risks, can be avoided. Further, the single interface sealing can provide unmatched safety for patients. Yet another advantage is that at least one side of the fitment base, and preferably two opposing sides of the fitment base, are oriented transverse to the fold plane and engage the respective and opposing side walls of the pouch, and are sealed thereto, forming a continuous, uninterrupted, single interface seal that extends about the perimeter of the port. As a result, the pouches overcome the disadvantages associated with the above-described prior art pouches where the fitments do not engage and are not sealed to the side walls of the pouches.

A further advantage is that the fitment may include either single or multiple connections, including multiple outflow connections. Yet another advantage is that the fitment can include a penetrable and resealable filling port, such as a needle penetrable and/or a one-way valve filling port, wherein the filling needle or filling cannula can undergo "wiping" during penetration and/or engagement with the filling port to facilitate a sterile connection therebetween. Yet another advantage is that the same fitment can include two or more ports, including, for example, anti-contamination dispensing ports of the exemplary type disclosed herein.

Other objects and/or advantages of the present invention, and/or of the currently preferred embodiments thereof, will become readily apparent in view of the following detailed description of embodiments and the accompanying drawings.

DETAILED DESCRIPTION OF EMBODIMENTS

Figure 1:
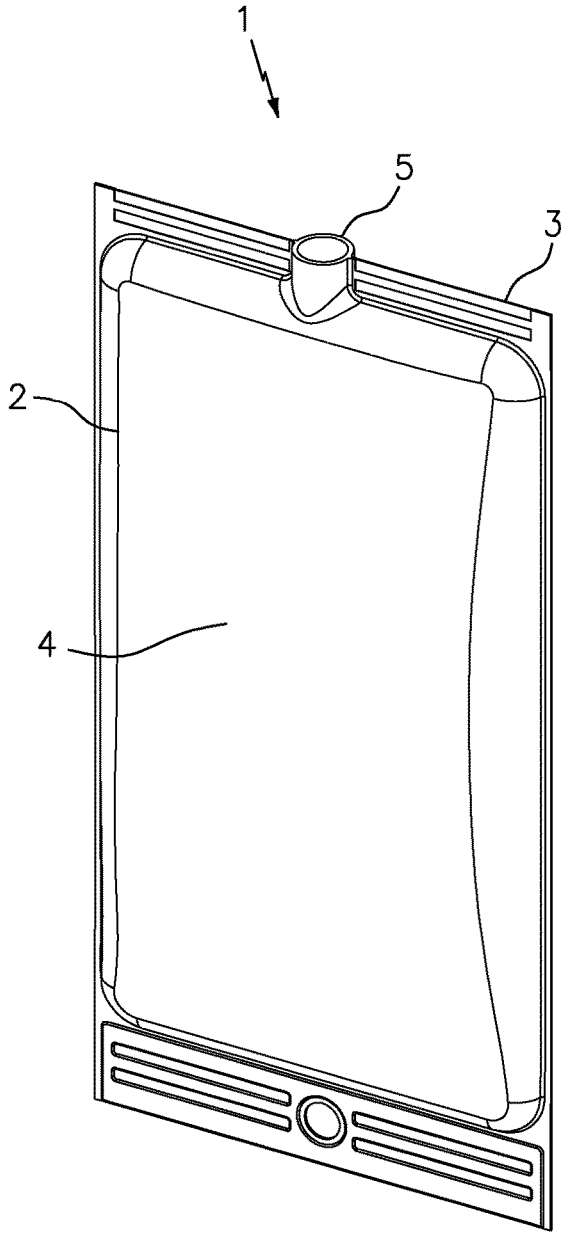
FIG. 1 is a perspective view of a pouch.
Figure 2:
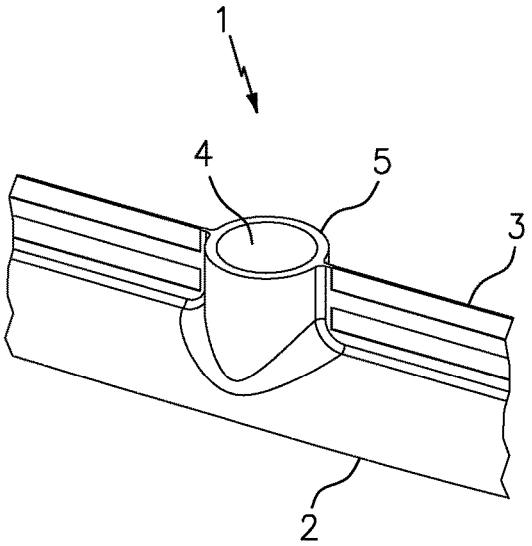
FIG. 2 is a partial, enlarged view of the pouch of FIG. 1 showing the rigid tube or outflow fitment forming the port, and the junctions of the rigid tube and opposing edges of the plastic films that must be sealed.
Figure 3:
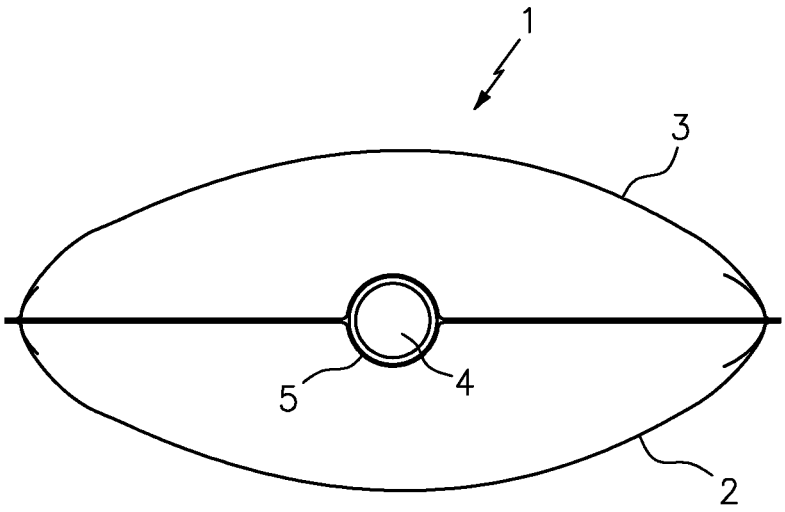
FIG. 3 is a partial, enlarged top plan view of the tube, plastic films, and junctions thereof of the pouch of FIG. 2.
Figure 4:
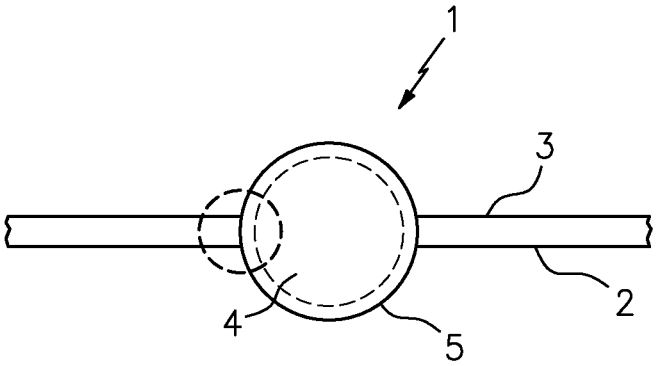
FIG. 4 is a somewhat schematic view of the tube, plastic films, and junctions thereof of the pouch of FIG. 3, and showing within a circle where a leak may occur at one of the three component/material junctions.

In FIGS. 5 through 8, a pouch embodying the present invention is indicated generally by the reference numeral 10. The pouch 10 comprises a film 12 that may define an aperture 14 therethrough. A fitment 16 of the pouch 10 includes a port 18 and a base 20 extending about the port. The base 20 and the film 12 overlap each other to thereby define an overlapping region 22, demarcated by inner perimeter 21 and outer perimeter 23. The port 18 is in fluid communication with the aperture 14, the base 20 and film 12 are sealed to each other within the overlapping region 22, and a continuous, uninterrupted, fluid-tight seal 24 is formed between the base 20 and film 12 that extends about the port 18.

In the illustrated embodiment, the base 20 and film 12 are sealed to each other along a perimeter seal 24, which extends about a perimeter 26 of the port 18. Preferably, the base 20 and film 12 are sealed to each other substantially throughout the overlapping region 22. In such embodiments, the perimeter seal 24 extends substantially from inner perimeter 21 to outer perimeter 23. As can be seen, the base 20 substantially surrounds the port 18, and the base and film 12 are sealed to each other throughout the perimeter seal 24 in the overlapping region 22 that surrounds the port 18. Also in the illustrated embodiment, the base 20 and film 12 are contiguous substantially throughout the overlapping region 22 and are sealed to each other substantially throughout the overlapping region.

Figure 5:
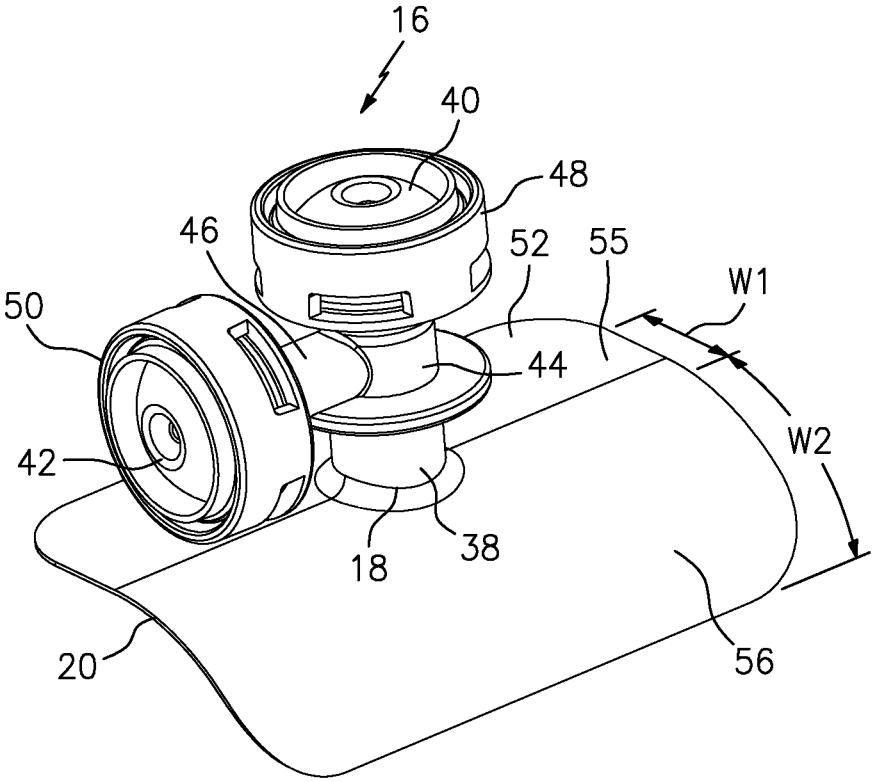
FIG. 5 is a perspective view of a fitment of a pouch in accordance with an embodiment of the invention, where the fitment includes two branches, one branch including a penetrable and resealable septum for filling the pouch with a substance, and another branch including a penetrable septum for sterile connecting to the pouch and withdrawing the filled substance therefrom.
Figure 6:
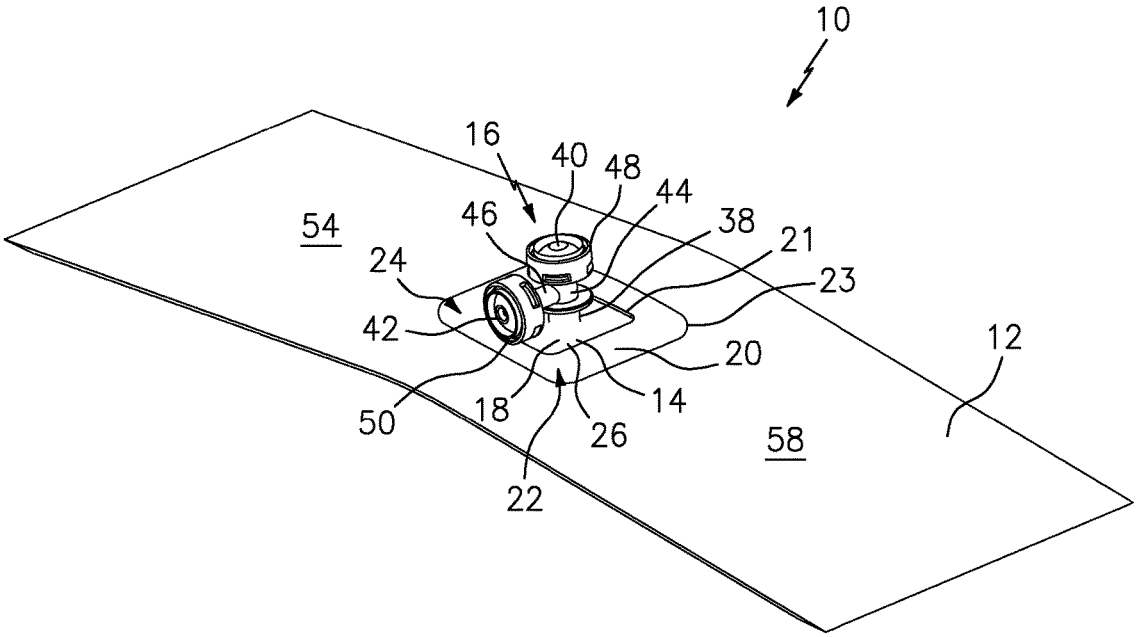
FIG. 6 is a perspective view of the fitment of FIG. 5 with an overlapping sheet of plastic film, where the fitment is in fluid communication with an aperture in the sheet, and is in position to seal the base of the fitment to the film in the overlapping region.
Figure 7:
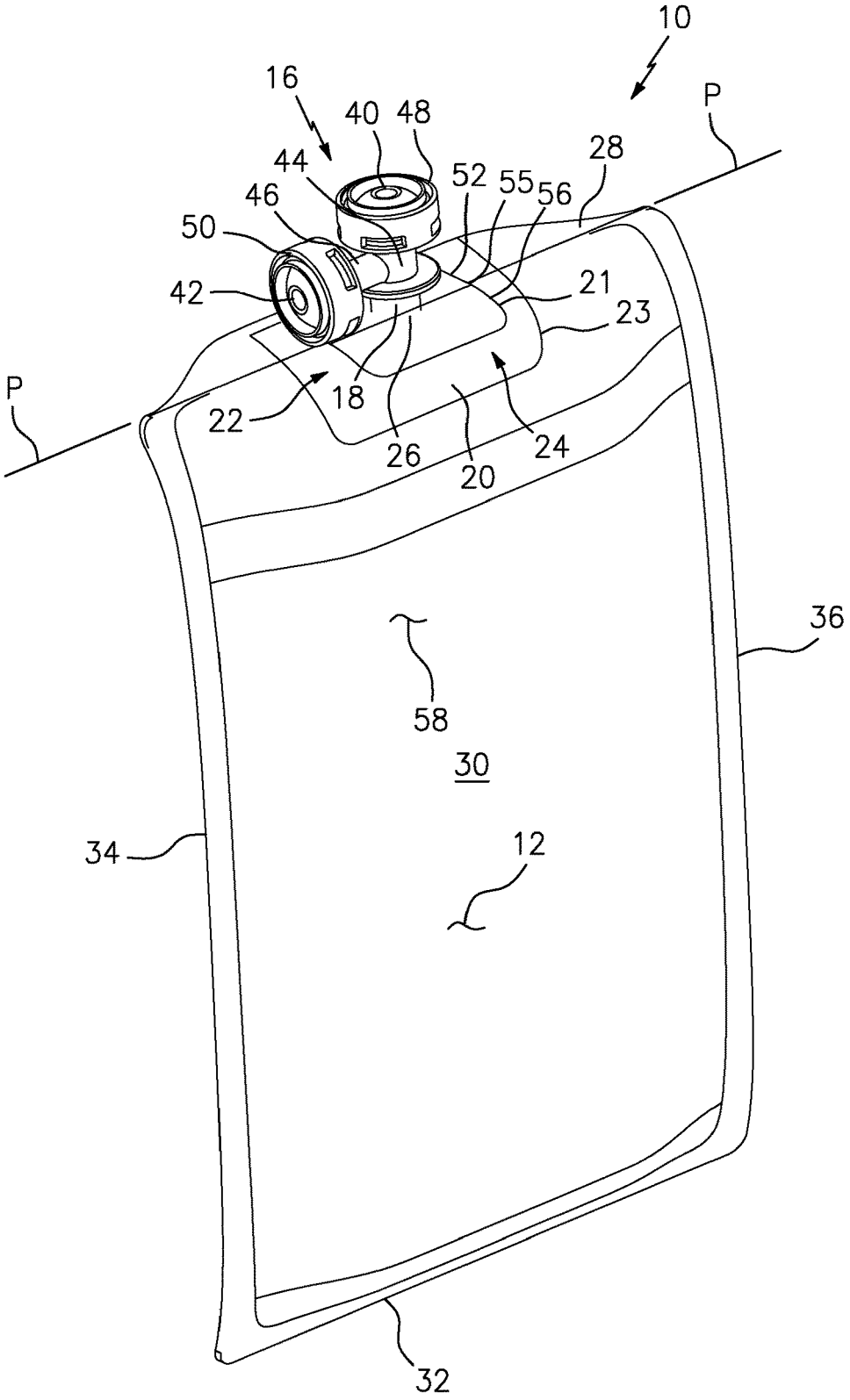
FIG. 7 is a perspective view of a pouch formed from the film and fitment of FIG. 5 by folding the film at the overlapping region, and sealing the opposing marginal edge portions of the film to, in turn, form a sealed interior chamber of the pouch.
Figure 8:
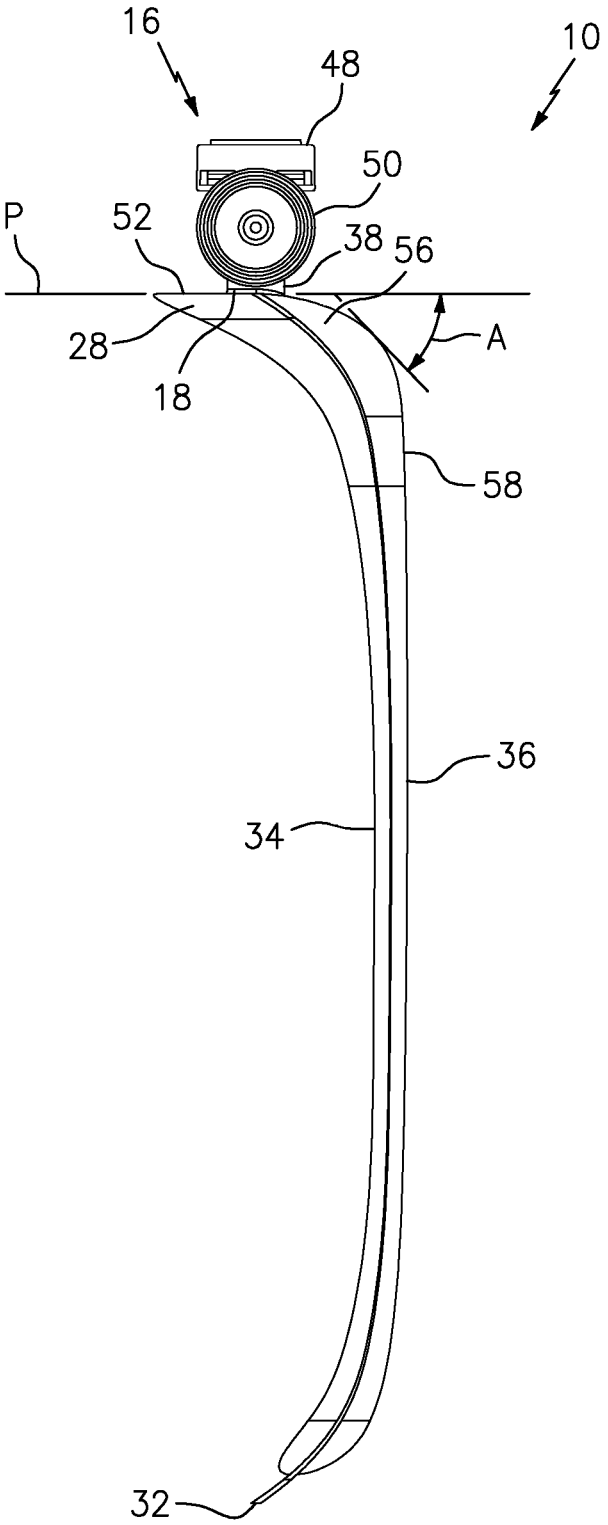
FIG. 8 is a side elevational view of the pouch of FIG. 7 shown in an empty condition with one side of the film collapsed into the opposing side of the film.

As shown in FIGS. 6 through 8, in the illustrated embodiment, the base 20 and film 12 are sealed to each other throughout a continuous, uninterrupted, substantially contiguous interface between the base 20 and film 12 that extends annularly about the port 18. As described further below, during sealing, the base 20 and film 12 preferably define (i) a sealed interface extending radially outwardly relative to the port 18, and extending annularly about the port, and/or (ii) a curved, sealed interface extending radially outwardly relative to the port 18, and extending annularly about the port. For example, in one embodiment, the base and film are placed on a flat or substantially flat support surface (not shown), and one of the overlapping parts is pressed or otherwise placed into engagement with the other, to conform at least the overlapping region 22 to the flat shape of the support surface. In another embodiment, the support surface is curved as shown by the exemplary curved base/film interface at the overlapping region 22 in FIG. 5. In each case, the base 22 and film 12 define at the overlapping region 22 a single, sealed interface which extends radially outwardly relative to the port 18, and extends annularly about the port.

As shown in FIGS. 7 and 8, the film 12 is folded at the overlapping region 22 to form a first marginal edge portion 28 of the pouch 10. A plurality of opposing edges of the film 12 are sealed to each other to thereby form a sealed pouch 10 defining a sealed chamber 30 therein. The pouch 10 defines a first marginal edge portion 28, a second marginal edge portion 32 located on an opposite side of the pouch relative to the first marginal edge portion 28, a third marginal edge portion 34 extending between the first and second marginal edge portions, and a fourth marginal edge portion 36 located on an opposite side of the pouch relative to the third marginal edge portion 34. The first marginal edge portion 28 is defined by the fold in the film 12, and the second, third and fourth marginal edge portions 32, 34 and 36, respectively, each are defined by sealed opposing marginal edge portions of the film. The pouch 10 defines a first side 54 and a second opposing side 58 with the sealed chamber 30 formed therebetween. In the illustrated embodiment, the pouch is formed of a single sheet of film 12. However, as may be recognized by those of ordinary skill in the pertinent art based on the teachings herein, the pouch 10 may be formed of a plurality of sheets, or may be formed by molding the pouch, such as by extrusion or co-extrusion (for multilayer films) molding, or blow molding.

The fitment 16 includes a boss 38 defining therein the port 18 and extending outwardly from the base 20. As indicated above, the film 12 is formed of a material that is flexible and bends in the overlapping region 22 to thereby allow the film to fold at the overlapping region and form the respective first marginal edge portion 28 of the pouch 10. The base 20, on the other hand, may be flexible or rigid, or may be flexible, but less so than the film, to support the fitment and pouch, and ensure a high integrity seal between the film and fitment during filling, dispensing, and otherwise during the life of the pouch. As shown typically in FIGS. 7 and 8, the fold in the film forming the marginal edge portion 28 defines a fold plane "P," the first side 54 of the pouch is transverse to the fold plane P, and the second side 58 opposite the first side also is transverse to the fold plane P. In the illustrated embodiments, the first and second sides 54 and 58, respectively, of the pouch are oriented approximately perpendicular to the fold plane P. However, as may be recognized by those of ordinary skill in the pertinent art based on the teachings herein, this angle is exemplary and may be changed as desired or otherwise required. The base 20 of the fitment defines a mid-portion 55, a first side 52 located on one side of the mid-portion, and a second side 56 located on an opposite side of the mid-portion relative to the first side. In the illustrated embodiment, the second side 56 of the base 20 is transverse to the fold plane P, and is engaged with the second side 58 of the pouch in the overlapping region 22 and is sealed thereto. The mid-portion 55 and first side 52 of the base, on the other hand, extend substantially along the fold plane P. The mid-portion 55 is engaged with, and sealed to the first marginal edge portion 28 of the pouch in the overlapping region, and the first side 52 is engaged with, and sealed to the first side 54 of the pouch in the overlapping region. As described further below, in other embodiments, both the first and second sides 52 and 56, respectively, of the base are transverse to the fold plane P, and are engaged with, and sealed to the first and second sides of the pouch 54 and 58, respectively. As shown typically in FIG. 5, the mid-portion 55 of the base 20 defines a first width "W1", the transverse second side 56 of the base defines a second width "W2" that is at least about 1½ times the first width W1, is preferably at least about 2 times the first width W1, and is even more preferably at least about 3 times the first width W1. As shown typically in FIG. 8, the transverse second side 56 of the base is oriented at an acute angle "A" relative to the fold plane P. In the illustrated embodiment, the angle A is within the range of greater than about 45° to less than about 90°. However, as may be recognized by those of ordinary skill in the pertinent art based on the teachings herein, these widths and angles are only exemplary, and may be changed as desired or otherwise required.

In the illustrated embodiment, the fitment 16 includes a first penetrable and resealable septum 40 and a second penetrable and resealable septum 42. Each penetrable septum 40 and 42 seals the chamber 30 with respect to ambient atmosphere. In one application of the pouch 10, the first septum 40 is a needle penetrable and resealable septum for sterile filling the chamber 30 of the pouch with a substance therethrough, and the resulting penetration aperture in the septum (not shown) is resealable by the application of heat, radiation, chemical sealant, such as a hot melt adhesive or a liquid silicone, or a mechanical seal thereto. In this same application of the pouch 10, the second septum 42 is a female connector of a sterile connector that is penetrable by a corresponding male connector to place the male and female connectors in sterile, fluid communication with each other, and to dispense the substance filled into the chamber 30 therefrom. As may be recognized by those of ordinary skill in the pertinent art based on the teachings herein, the fitments of the pouches of the present invention may take any of numerous different configurations that are currently known, or that later become known. For example, the fitment(s) may include only one septum, may include more than two septa, may include one or more septa and one or more sterile connectors, and/or may include one or more sterile connectors without any septa, and a pouch or other device may include more than one fitment. However, each septum may take the form of any of the septa disclosed in the following co-pending patent applications, which are hereby expressly incorporated by reference in their entireties as part of the present disclosure: U.S. Provisional Patent Application No. 62/219,035, filed Sep. 15, 2015, entitled "Septum that Decontaminates by Interaction with Penetrating Element"; and U.S. Design patent application Ser. No. 29/539,571, filed Sep. 15, 2015, entitled "Septum."

As shown in FIG. 5, the boss 18 extends axially outwardly from the base 20 and defines a first branch or sprout 44 at the axial end of the boss, and a second branch or sprout 46 extending laterally or radially from the boss. In the illustrated embodiment, each branch defines the same tubular cross-sectional shape as the boss 18, and is in fluid communication with the boss and port 18 thereof. The first branch 44 includes on the distal end thereof a first cup or flange 48 defining a first recessed surface for receiving therein the first septum 40, and the second branch 46 includes on the distal end thereof a second cup or flange 50 defining a second recessed surface that receives therein the second septum 42. In one embodiment, the base 20 and boss 38 (including the branches 44 and 46 thereof) are molded in one piece from the same material, and the first and second septa 40 and 42 are over molded or co-molded within the respective recessed surfaces of the flanges 48 and 50, respectively.

As shown best in FIG. 8, in this exemplary embodiment, the base 20 is asymmetric about the port 18. As indicated above, the base 20 may be made of a material that is flexible but relatively rigid in comparison to the film 12. The base 20 defines a first side 52 overlapping a first side 54 of the pouch 10, and a second side 56 overlapping a second side 58 of the pouch. As can be seen, the second side 56 of the base 20 is wider than the first side 52 of the base. In the illustrated embodiment, the width of the second side 56 of the base 20 is about 1⅓ to about 2 times the width of the first side 52 of the base. When the pouch 10 is empty, the first side 54 of the pouch 10 collapses toward and/or into the second side 58 of the pouch. In the illustrated embodiment, the fitment 16 is located substantially at a bottom of the pouch 10. One advantage of this configuration, is that when the pouch is emptied, substantially all of the substance within the pouch is allowed to flow out of the pouch, and thus there is substantially zero, or very little, if any, residual substance that remains in the pouch when emptied (or "ullage").

The pouch 10 may be manufactured in accordance with a method comprising the following steps:

(i) sealing the base 20 of the fitment 16 and the film 12 to each other about the port 18 of the fitment, as shown in FIG. 6;

(ii) folding the film 12 at the base 20 of the fitment 16 and forming a first marginal edge portion 28 of the pouch 10 at the fold, as shown in FIG. 7; and (iii) sealing the opposing marginal edge portions of the film 12 and thereby forming a pouch 10 defining the sealed empty chamber 30 therein in fluid communication with the port 18 of the fitment 16, as also shown in FIG. 7.

Step (i) may further include forming the aperture 14 in the film 12, overlapping the base 20 of the fitment 16 and the film 12, forming an overlapping region 22 about the perimeter 26 of the aperture, and sealing the base 20 and film 12 to each other about the perimeter 26 of the aperture. As can be seen, the base 20 and the film 12 are contiguous to each other throughout the overlapping region. The sealing step preferably comprises sealing the base 20 and film 12 to each other substantially throughout the overlapping region 22, and further, sealing the base 20 and contiguous film 12 to the other along the perimeter 26 of the aperture 14, to thereby ensure a fluid-tight seal between the pouch chamber 30 and ambient atmosphere.

In the illustrated embodiment, step (ii) includes folding the film 12 at the overlapping region 22 and forming the first marginal edge portion 28 of the pouch thereat. In the illustrated embodiment, the base 20 and film 12 are sealed to each other in the overlapping region 22 prior to folding the film at the first marginal edge portion 28. In this way, the overlapping base and film may be sealed to each other in a substantially flat or flattened condition. Accordingly, the base of the fitment and the overlapping portion of the film may be maintained in a substantially flattened condition during the sealing step, and then after the sealing step, the sealed base and film may be bent to form the first marginal edge portion 28 of the pouch thereat. However, if desired, the base and film may be sealed to each other after folding the film at the first marginal portion 28. Also in the illustrated embodiment, step (iii) further comprises sealing the plurality of opposing edge portions of the film 12 to each other to form the sealed pouch 10 defining the chamber 30 therein, the second marginal edge portion 32 located on an opposite side of the pouch relative to the first marginal edge portion 28, the third marginal edge portion 34 extending between the first and second marginal edge portions 28 and 30, respectively, and the fourth marginal edge portion 36 located on an opposite side of the pouch relative to the third marginal edge portion 34.

Figure 9:
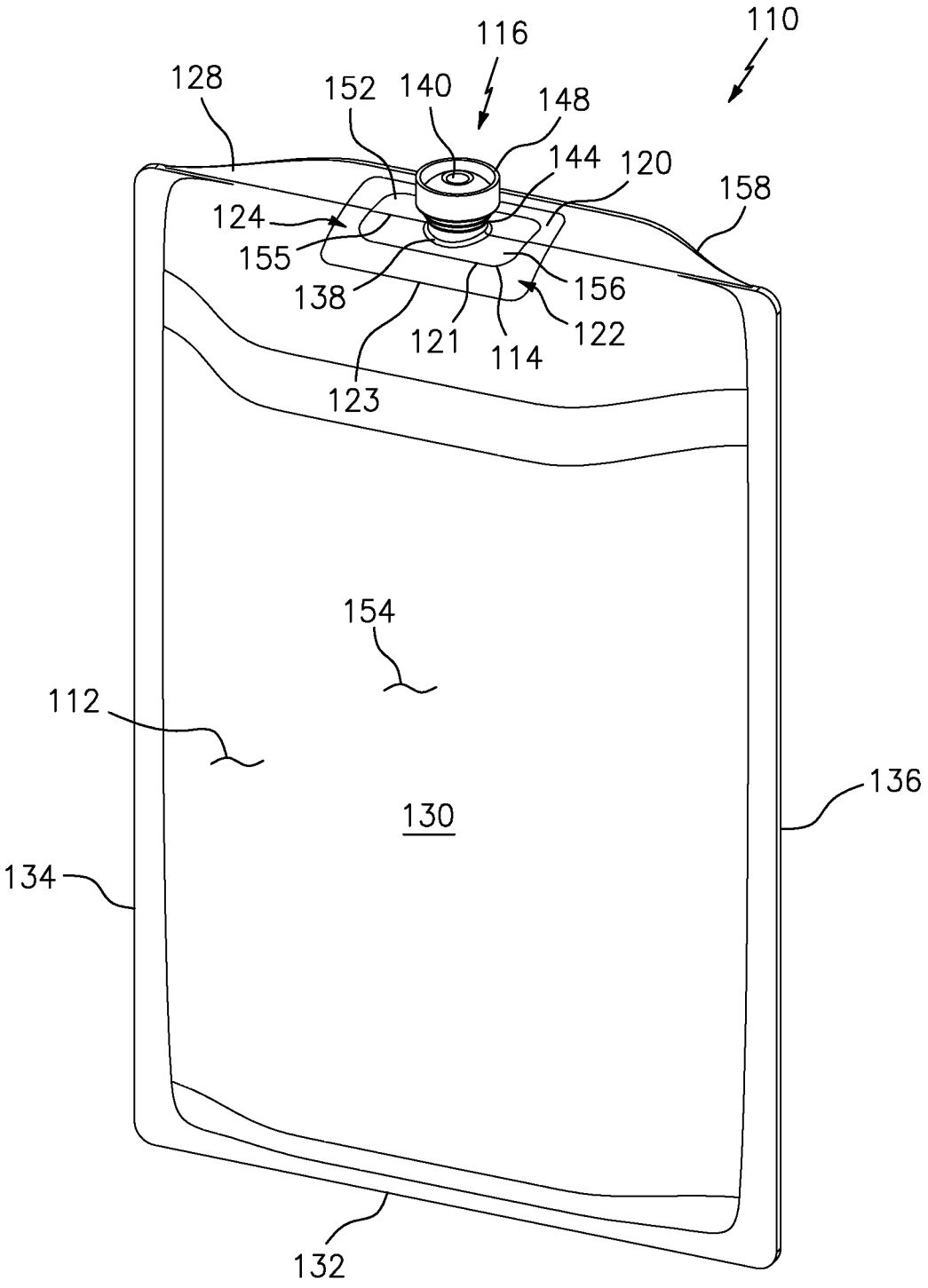
FIG. 9 is a perspective view of another embodiment of a pouch including a fitment with a single penetrable and resealable septum that may be used to sterile fill the pouch with a substance and to withdraw the filled substance from the pouch.
Figure 10:
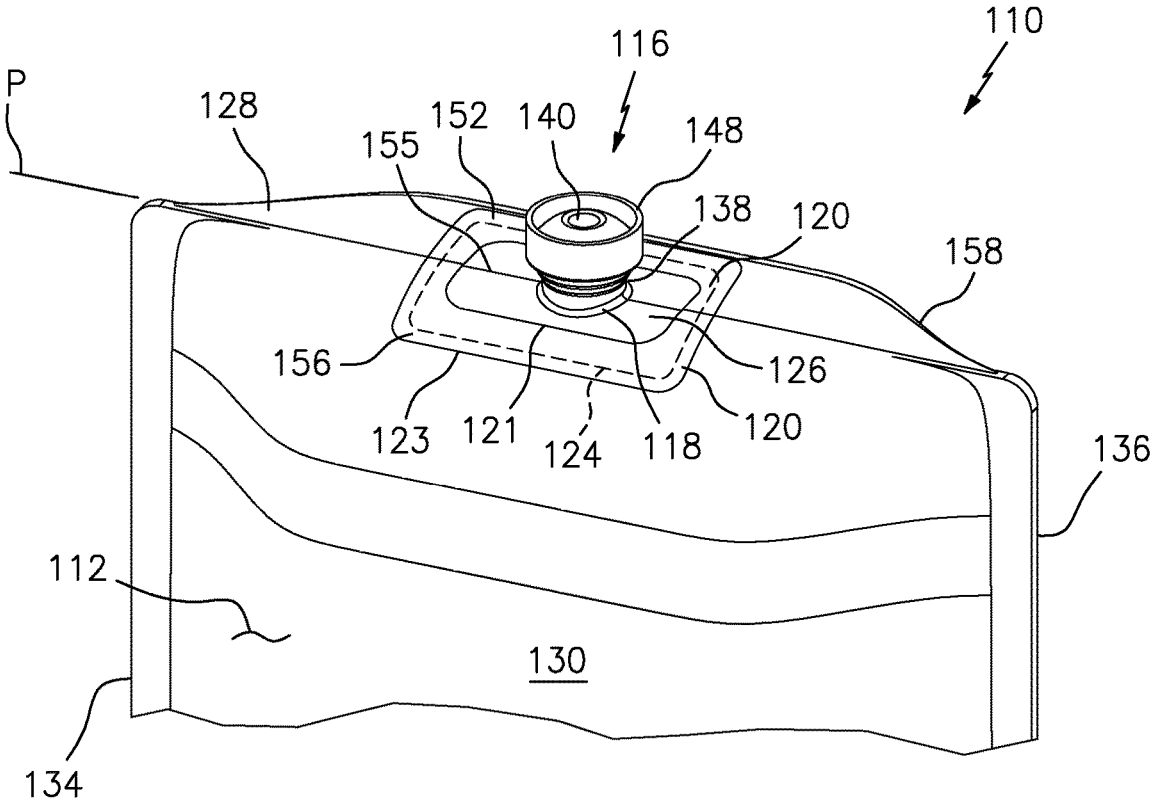
FIG. 10 is an enlarged, partial, upper perspective view of the pouch of FIG. 9 marked with dashed lines to show how the single interface, perimeter seal in the overlapping region of the base and film extends about the perimeter of the port, which in the illustrated embodiment, extends completely around the outflow port without discontinuities in the single seal interface.
Figure 11:
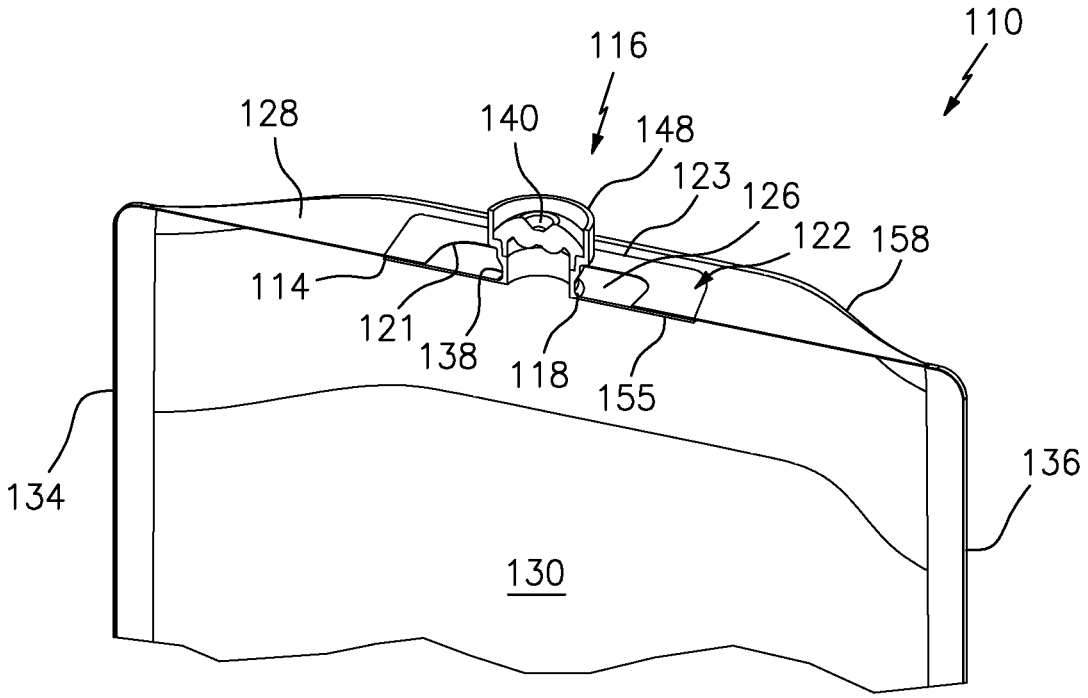
FIG. 11 is an enlarged, partial, cross-sectional view of the fitment and overlapping region of the base of the fitment and film of the pouch of FIG. 10.

In FIGS. 9 through 11, another pouch embodying the present invention is indicated generally by the reference numeral 110. The pouch 110 is substantially similar to the pouch 10 described above, and therefore like reference numerals preceded by the numeral "1" are used to indicate like elements. In the illustrated embodiment, as shown in FIG. 10, dashed lines show how the single interface, perimeter seal 124 within the overlapping region 122 of the base 120 and film 118, extends completely about the perimeter 126 of the port 118 without discontinuities in the single seal interface. In the illustrated embodiment, the seal extends not only throughout the dotted line, but also substantially throughout the overlapping region 122. The pouch 110 differs in that the fitment 116 includes a single branch and fitting 144 with a single penetrable and resealable septum 140 that may be used (i) to sterile fill the pouch with a substance and (ii) to withdraw the filled substance from the pouch. As described further below, the chamber 130 of the pouch 110 may be sterile filled by penetrating the elastic septum 140 with a needle or like injection member, filling the pouch through the needle, withdrawing the needle, and resealing the resulting penetration aperture in the septum to seal the sterile filled chamber from the ambient atmosphere. Then, the substance filled into the chamber 130 may be dispensed or otherwise withdrawn from the chamber by piercing the septum 140 with a needle, cannula or like device. Re-piercing of the septum with a needle or other spike can be a source of contamination in a hospital environment. Accordingly, in order to avoid such contamination, the fitment may preferably include one or more dispensing or outflow ports as disclosed in other exemplary embodiments herein.

Figure 12:
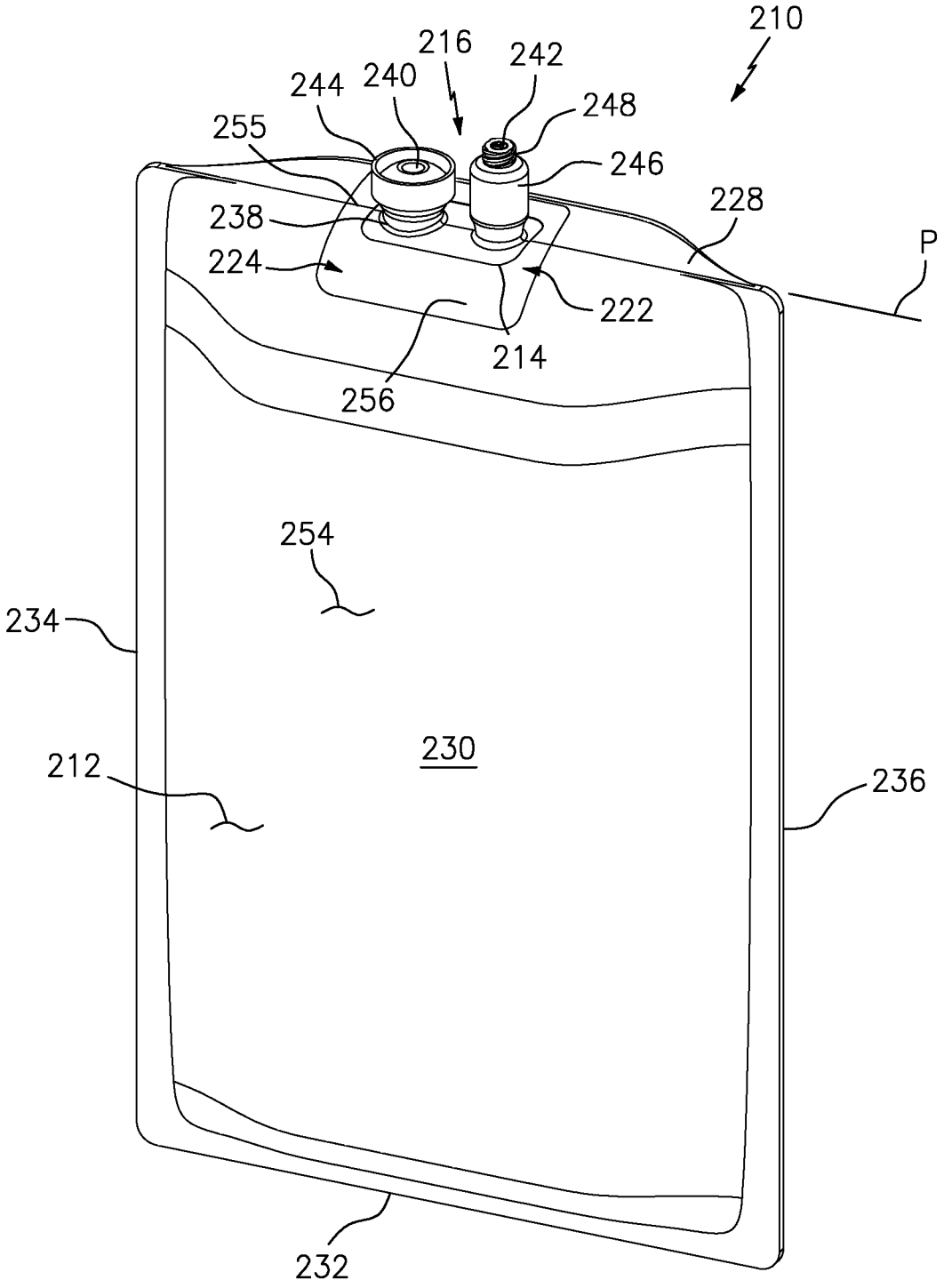
FIG. 12 is a perspective view of another embodiment of a pouch comprising a single fitment including a first fitting with a penetrable and resealable septum that may be used to fill the pouch with a substance, and a second fitting including a stretchable spring, normally-closed, two-way valve and a luer connector for withdrawing the filled substance from the chamber into, for example, a syringe, or which can be connected to, for example, an IV tubing to gravity feed a product from the pouch into the tubing.
Figure 13A:
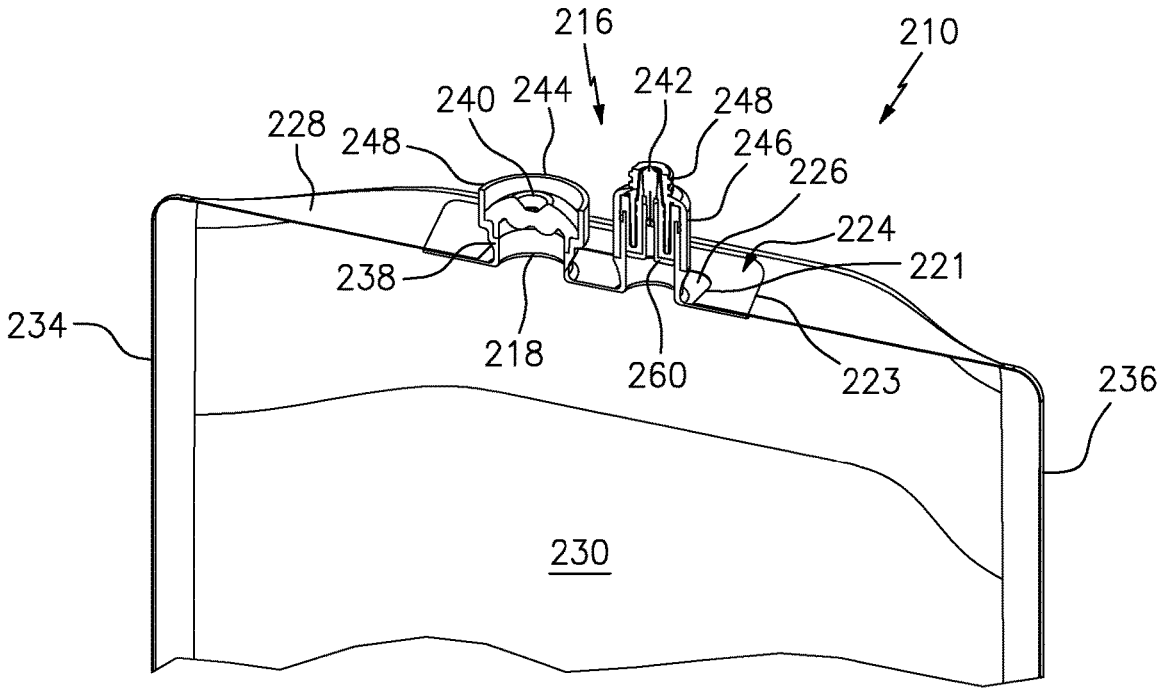
FIG. 13A is an enlarged, partial, cross-sectional view of the fitment and overlapping region of the fitment base and film of the pouch of FIG. 12 showing the valve of the second fitting in a closed position.

In FIGS. 12 and 13A and B, another pouch embodying the present invention is indicated generally by the reference numeral 210. The pouch 210 is substantially similar to the pouches 10 and 110 described above, and therefore like reference numerals preceded by the numeral "2", or preceded by the numeral "2" instead of the numeral "1", are used to indicate like elements. The pouch 210 differs in that the fitment 216 includes a first fitting 244 and a second fitting 246. In the illustrated embodiment, the first fitting 244 defines a first port for filling a substance into the pouch chamber 230, and the second fitting 246 defines a second port for dispensing or extracting substance from the chamber. The first fitting 244 forms a fluid-tight seal between the chamber and ambient atmosphere, and is configured to fill a substance through the first port and into the chamber. The second fitting 246 forms a fluid-tight seal between the pouch chamber 230 and ambient atmosphere, and is configured to dispense, extract or otherwise withdraw the filled substance from the pouch chamber.

In the illustrated application of the pouch 210, (i) the first fitting 244 includes a septum 240 that is penetrable by a needle or like injection member, and (ii) the second fitting 246 defines an anti-air and multiple dose ("AAAMD") port. The AAAMD port includes a normally-closed valve 242 that is engageable by a device, such as a syringe (not shown), (i) to open the valve 242 and dispense, extract or otherwise withdraw substance from the pouch chamber 230, as indicated by the arrows in FIG. 13B, and then (ii) to disconnect the device, close the valve 242, and maintain a fluid-tight seal between the pouch chamber 230 and ambient atmosphere, as shown in FIG. 13A. Accordingly, the AAAMD port can form a needleless and sterile connection through a luer connector to a syringe or other device. As a result, the fitment with single interface seal and AAAMD port can prevent any germ ingress into the pouch and can prevent as well any injection into the pouch of liquid or air. Accordingly, this pouch and fitment configuration provides significant advantages in applications and/or campaigns where multiple persons must be injected and/or for storing products in a single reservoir without risk of contamination between the many samplings or doses from the pouch for different patients.

Figure 13B:
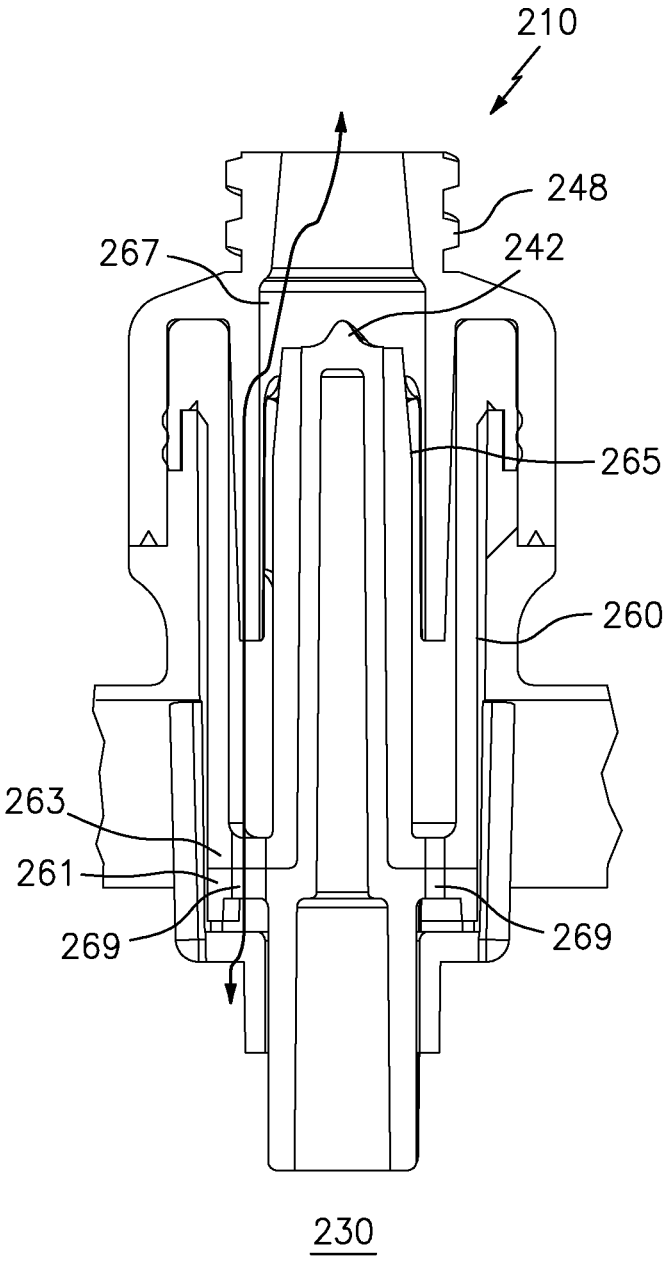
FIG. 13B is an enlarged, partial, cross-sectional view of the second fitting of the fitment of the pouch of FIG. 12 showing the valve of the second fitting in an open position and illustrating with arrows a bi-directional fluid flow through the valve in an open position.

As shown best in FIGS. 13A and B, the fitting 246 includes a threaded connector 248, such as a male luer connector, that is connectable to a syringe or IV connector, for example. When a syringe, IV connector or other device with a corresponding female luer connector (not shown) is connected to the male luer connector 248, the syringe engages and depresses the normally-closed, spring-biased valve 242, as shown typically in FIG. 13B, to open the valve 242 and, in turn, allow the withdrawal of substance from the pouch chamber through the open valve. As shown in FIG. 13B, the valve 242 includes an annular flange 261 fixedly connected to a base 263 of the elastic spring 260 to allow movement of the elastic spring with the valve. Thus, depression of the valve 242, as shown in FIG. 13B, causes the base 263 of the elastic spring 260 to move with the valve 242 and, in turn, stretch the spring. This, in turn, causes an annular seal 265 of the valve 242 formed integral with the spring 260 and extending about the valve, to move away from an annular valve seat 267 and thereby open the valve and allow fluid flow therethrough. Apertures 269 are formed through the valve flange 261 and spring base 262 to place the valve 242 in fluid communication with the pouch chamber 230 and allow fluid flow therebetween. Then, when the syringe, IV connector or other device is disengaged from the connector 248, the stretched elastic spring 260 connected to the valve 242 biases the valve back into its normally-closed position, as shown in FIG. 13, such that the annular seal 265 is spring biased into engagement with the annular valve seat 267 to form a fluid-tight seal therebetween and thereby seal the valve and pouch chamber 230 from ambient atmosphere. The second fitting 246, including the valve 242, spring 260 and connector 248 may be the same as, substantially the same as, or similar to such components disclosed in the following co-pending patent applications, which are hereby incorporated by reference in their entireties as part of the present disclosure: U.S. patent application Ser. No. 13/744,379, filed Jan. 17, 2013 and entitled "Multiple Dose Vial and Method," which claims the benefit of similarly-titled U.S. Provisional Patent Application No. 61/587,525, filed Jan. 17, 2012; and U.S. patent application Ser. No. 14/208,030, filed Mar. 13, 2014 and entitled "Device with Sliding Stopper and Related Method," which claims the benefit of similarly-titled U.S. Provisional Patent Application No. 61/799,423, filed Mar. 15, 2013.

Figure 14A:
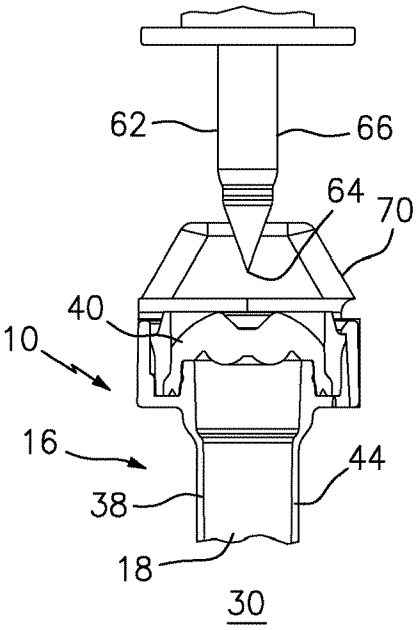
FIGS. 14A through D are a series of progressive, partial, cross-sectional views of a fitment of the types shown in FIGS. 5 through 13 illustrating how the chamber of the pouch is filled with a substance by (i) penetrating the septum with a normally-closed filling needle, as shown in FIGS. 14A and B, (ii) opening the closure of the filling needle after the needle penetrates the septum to inject or otherwise dispense the substance through the needle and into the chamber, as shown in FIG. 14C, (iii) closure of the needle after filling the substance into the pouch chamber, as shown in FIG. 14D, and then (iv) withdrawal of the closed needle back through the septum.
Figure 14B:
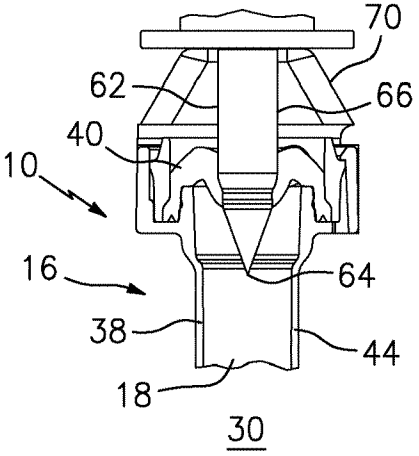
Figure 14C:
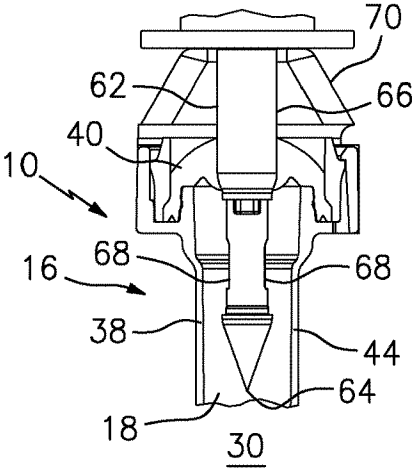
Figure 14D:
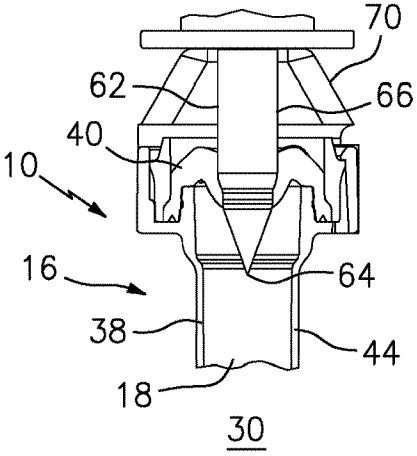

FIGS. 14A through D illustrate progressively how the penetrable septum 40 of FIGS. 5 through 8, and similarly the penetrable septa 140 and 240 of FIGS. 9 through 13, may be used to sterile fill the respective pouch chamber with a substance by (i) penetrating the elastic septum 40 with a normally-closed filling needle assembly 62, as shown in FIGS. 14A and B; (ii) opening a closure 66 of the filling needle assembly 62 after the needle tip 64 penetrates the septum 40 to expose the needle eyes or apertures 66 to the sterile chamber 30 and, in turn, inject or otherwise dispense the substance through the needle eyes 68 and into the chamber 30, as shown in FIG. 14C; (iii) closing the needle assembly 62 after filling the substance into the pouch chamber 30, as shown in FIG. 14D; and then (iv) withdrawing the closed needle assembly 62 back through the septum 40. As can be seen, the normally-closed needle assembly 62 is opened by engaging the closure 66 thereof against a fixture 70 when the needle tip 64 penetrates through the septum 40, and by further depressing the needle tip 64 relative to the fixed closure 66 to expose the needle eyes 68 to the interior chamber 30 and thereby open the normally-closed needle assembly to the sterile chamber. The closed needle assembly 62 includes a spring, such as an elastic spring or a coil spring, that normally biases the closure 66 toward and into engagement with the tip 64 of the needle to seal the needle eyes 68 from ambient atmosphere, and thereby maintain the needle eyes 68 and other interior surfaces of the needle sterile. The closed needle assembly, septa, and fixtures, may be the same as, or substantially similar to the disclosures of the following co-pending patent applications, which are hereby incorporated by reference in their entireties as part of the present disclosure: U.S. patent application Ser. No. 14/208,030, filed Mar. 13, 2014 and entitled "Device with Sliding Stopper and Related Method," which claims the benefit of similarly-titled U.S. Provisional Patent Application No. 61/799,423, filed Mar. 15, 2013; and U.S. patent application Ser. No. 13/864,919, filed Apr. 17, 2013 and entitled "Self Closing Connector," which claims the benefit similarly-titled U.S. Provisional Patent Application Nos. 61/625,663, filed Apr. 17, 2012, 61/635,258, filed Apr. 18,2012, and 61/784,764, filed Mar. 14, 2013; and U.S. patent application Ser. No. 14/214,890, filed Mar. 15, 2014 and entitled "Controlled Non-Classified Filling Device And Method," which claims the benefit of similarly-titled U.S. Provisional Patent Application No. 61/798,210, filed Mar. 15, 2013.

Prior to filling the pouch chamber as described above, the method may further comprise introducing a fluid sterilant, such as nitric oxide or ozone, into the interior of the pouch or pouch chamber to sterilize the pouch. The fluid sterilant may be introduced by penetrating the septum with a closed needle or like injection member, introducing the fluid sterilant through the needle or like injection member and into the pouch chamber, withdrawing the needle, and allowing the septum to reseal itself and retain the fluid sterilant in the pouch for a period of time sufficient to sterilize the interior of the pouch. The fluid sterilant, equipment for introducing the fluid sterilant, and/or process for sterilizing the pouch, may be based upon or in accordance with the disclosures of the following co-pending patent applications which are hereby incorporated by reference in their entireties as part of the present disclosure: U.S. patent application Ser. No. 13/529,951, filed Jun. 21, 2012, and titled "Fluid Sterilant Injection Device and Method," which claims priority from U.S. Provisional Patent Application No. 61/499,626, filed Jun. 21, 2011, and titled "Nitric Oxide Sterilization Device and Method"; U.S. patent application Ser. No. 14/704,549, filed May 5, 2015, and titled "Sterilizing Apparatus and Related Method, which claims priority from of U.S. patent application Ser. No. 13/419,204, filed Mar. 13, 2012, now U.S. Pat. No. 9,022,079, and titled "Container Closure with Overlying Needle Penetrable and Thermally Resealable Portion and Underlying Portion Compatible with Fat Containing Liquid Product, and Related Method," which is a continuation of similarly titled U.S. patent application Ser. No. 12/894,224, filed Sept. 30, 2010, now U.S. Pat. No. 8,132,600, which is a divisional of similarly titled U.S. patent application Ser. No. 11/339,966, filed Jan. 25, 2006, now U.S. Pat. No. 7,954,521, which claims priority to U.S. Provisional Patent Application No. 60/647,049, filed Jan. 25, 2005, entitled "Container with Needle Penetrable and Thermally Resealable Stopper, Snap-Ring, and Cap for Securing Stopper and Snap-Ring to Container and Removing Same Therefrom."

FIGS. 15A through F illustrate another embodiment of a fitting of a pouch that may embody the present invention where the fitting 48 includes a penetrable septum 40 similar to those shown in FIGS. 5 through 13. However, the fitting 48 forms a female connector 72 of a sterile connector 74 that is engageable with a corresponding male connector 76 to allow a sterile connection and flow of fluid or other substance into and/or out of the pouch. Like the closed needle assembly disclosed above in connection with FIGS. 14A through D, the male connector 76 comprises a closed needle assembly 62 including a needle defining a needle tip 64, a needle closure 66, and needle eyes 68. An elastic spring 78, which in the illustrated embodiment is dome shaped, normally biases the closure 66 toward and into engagement with the tip 64 of the needle to seal the needle eyes 68 from ambient atmosphere, and thereby maintain the needle eyes 68 and other interior surfaces of the needle sterile. As may be recognized by those of ordinary skill in the pertinent art based on the teachings herein, another type of spring, such as a coil spring, may be substituted for the illustrated elastic spring. The female connector 72 includes a female connector housing 80, and the male connector 76 includes a male connector housing 82 that is slidably received within the female connector housing to connect the male and female connectors and form a sterile connection as hereinafter described.

Figure 15A:
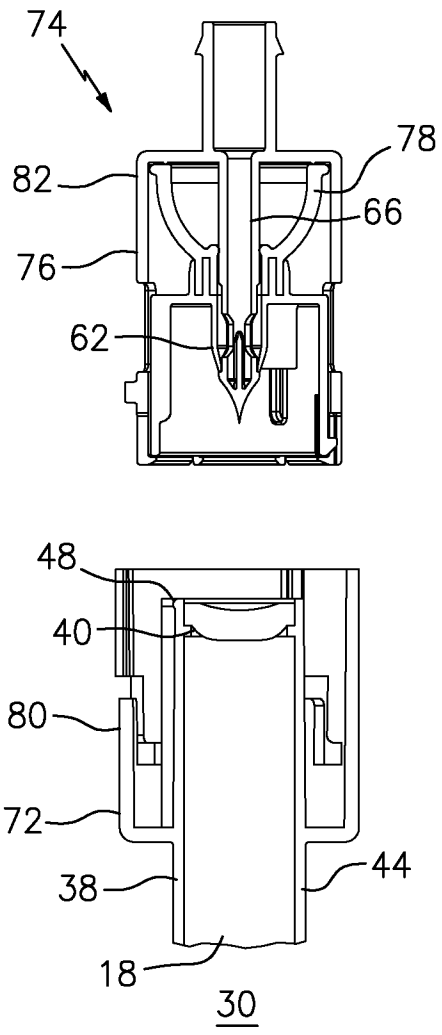
FIGS. 15A through F are a series of progressive, partial, cross-sectional views of a fitment of the types shown in FIGS. 5 through 13 forming a female connector of a sterile connector that is engageable with a corresponding male connector to allow a sterile connection and flow of fluid or other substance into and/or out of the pouch, by (i) penetrating the septum with a normally-closed needle of the male connector, as shown in FIGS. 15A through C, (ii) opening the spring-biased closure of the needle after the needle penetrates the septum to allow sterile fluid flow through the connector and into and/or out of the pouch chamber, as shown in FIGS. 15D through E, (iii) closure of the needle prior to withdrawal of the needle from the septum, and then (iv) withdrawal of the closed needle back through the septum to disconnect the male and female connectors.
Figure 15B:
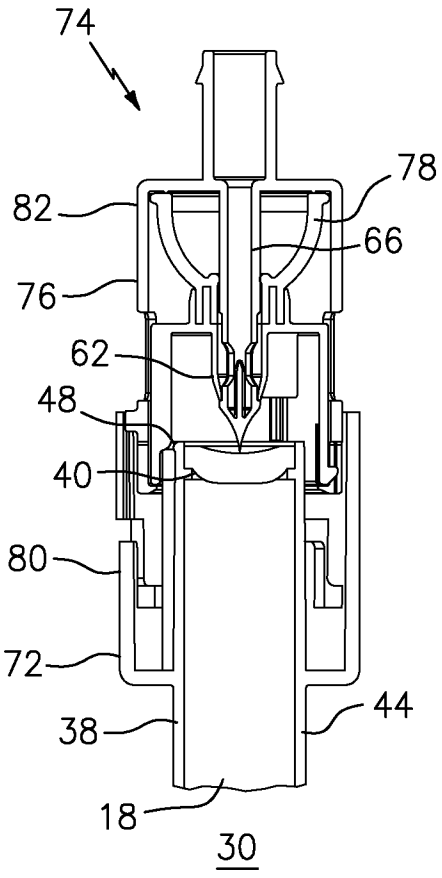
Figure 15C:
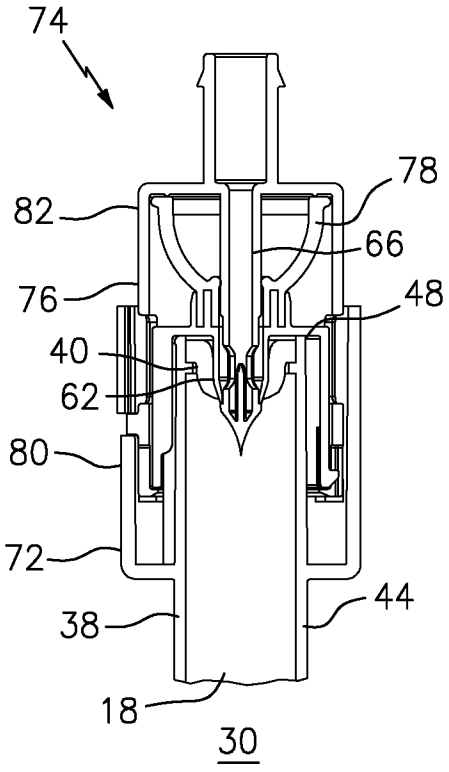
Figure 15F:
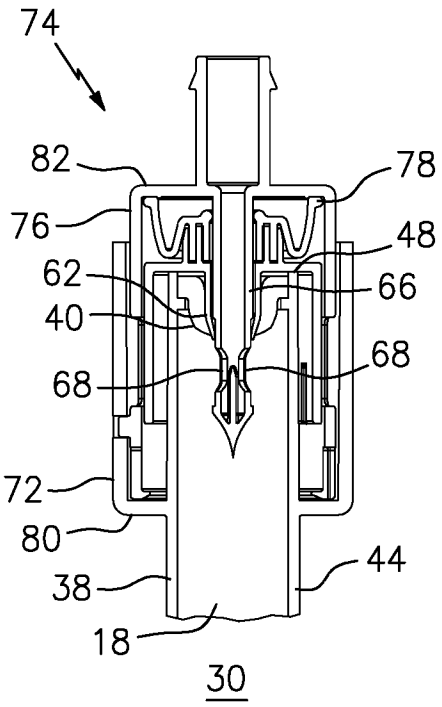
Figure 15E:
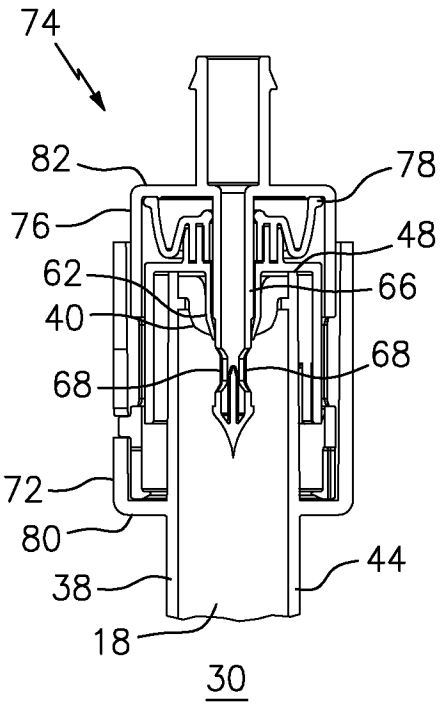
Figure 15D:
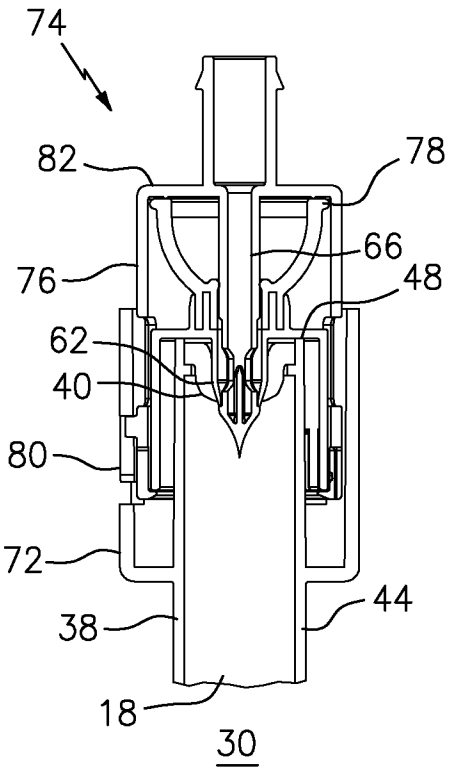

As shown in FIGS. 15A and B, the male connector 76 and/or the female connector 72 is moved into engagement with the other such that the male connector housing 82 is slidably received within the female connector housing 80. As shown in FIGS. 15B and C, further pressing at least one of the male connector 76 and female connector 72 into engagement with the other causes the closed needle assembly 62 of the male connector to penetrate the septum 40 of the female connector with the normally-closed needle assembly 62 of the male connector. Then, as shown in FIG. 15D, after the needle tip 64 penetrates through the septum 40 and is in fluid communication with the sterile chamber 30 of the pouch, the flange of the closure 66 engages the distal end of the fitting 48 to prevent further movement of the closure 66 toward the female connector 72. At this point, and as shown in FIG. 15D, the male connector housing 82 is manually rotated relative to the female connector housing 72 (e.g., by about 20°) to unlock the needle tip 64 from the closure 66 of the normally-closed needle assembly 62 and, in turn, allow further manual movement of the needle tip 64 relative to the fixed closure 66 and against the bias of the elastic spring 78 toward and into the female connector. As shown in FIG. 15E, such further manual movement exposes the needle eyes 68 to the sterile chamber 30 of the pouch, and thereby allows sterile fluid flow through the connector and into and/or out of the pouch chamber. In order to lock the sterile connector 74 in the open position, and as shown in FIG. 15F, the male connector housing 82 is further rotated relative to the female connector housing. Then, in order to disconnect the sterile connector 74, the foregoing steps may be essentially reversed. During disconnection, the elastic spring 78 normally biases the closure 66 toward and into engagement with the needle tip 64 to seal the needle eyes 68 from ambient atmosphere and thereby maintain the needle eyes and interior surfaces of the male connector 76 sterile when withdrawn through the septum. The septum 40 is self-resealing to maintain a fluid-tight seal at the site of the resulting penetration aperture after the sterile connector 74 is disconnected.

The sterile connector 74, including the closed needle and septum thereof, may be the same as, or substantially similar to the disclosures of the following co-pending patent applications, which are hereby incorporated by reference in their entireties as part of the present disclosure: U.S. patent application Ser. No. 13/864,919, filed Apr. 17, 2013 and entitled "Self Closing Connector," which claims the benefit similarly-titled U.S. Provisional Patent Application Nos. 61/625,663, filed Apr. 17, 2012, 61/635,258, filed Apr. 18, 2012, and 61/784,764, filed Mar. 14, 2013.

In FIGS. 16A through D, another embodiment of a fitting that may be used in the pouches embodying the present invention is indicated generally by the reference numeral 348. The fitting 348, the fitment that it is part of, and the pouch to which it is attached, are the same and/or similar in certain respects to the fittings, fitments and pouches described above, and therefore like reference numerals preceded by the numeral "3", or preceded by the numeral "3"

instead of the numerals "1" or "2", are used to indicate like elements. One difference of this embodiment is that the fitting 348 includes a spring-biased filling valve 340 that is engageable by a normally-closed filling probe 362 to fill the chamber 330 of the pouch 310 (not shown) with a substance. The filling head 376 includes a normally-closed filling probe assembly 362 including a filling probe defining a probe tip 364, a probe closure 366, and probe eyes or apertures 368. A coil spring 378 normally biases the closure 366 toward and into engagement with the tip 364 of the probe to seal the probe eyes 366 from ambient atmosphere, and thereby maintain the probe eyes 366 and other interior surfaces of the probe sterile. The filling head 376 includes a female housing 382, and the fitting 348 defines a male housing 380 that is slidably received within the female housing 382 to connect the filling head to the filling valve 340. The filling valve 340 includes a valve seat 384, a valve 386, and a spring 388 that normally biases the valve 386 into engagement with the valve seat to form a fluid-tight seal that seals the chamber 330 of the pouch from ambient atmosphere. The filling head 376 is connected to the fitting 348 to sterile fill a substance through the filling valve 340 as hereinafter set forth.

Figure 16B:
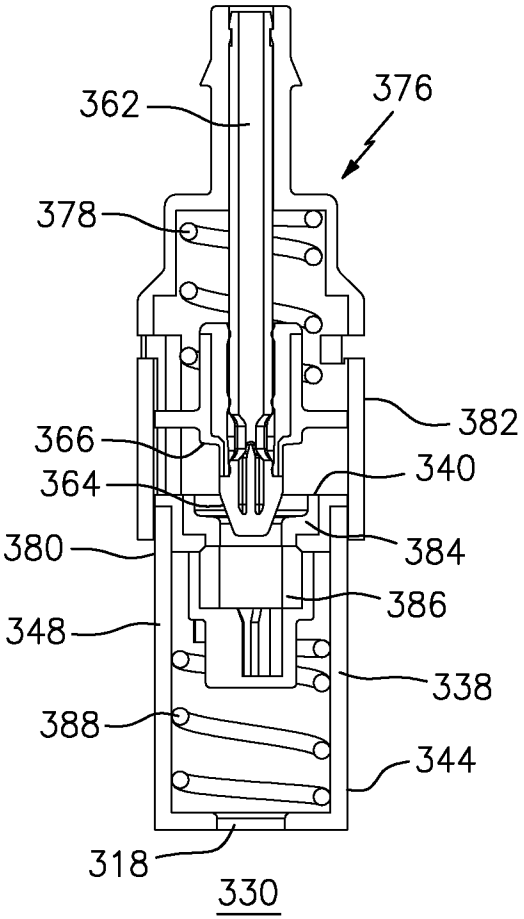
FIGS. 16A through D are a series of progressive, partial, cross-sectional views of a fitment used in a pouch of the type shown in FIGS. 20 through 22 where the fitment includes a spring-biased filling valve that is engageable by a normally-closed filling probe to fill the chamber of the pouch with a substance by (i) depressing the filling valve against the bias of the spring with the closed filling probe to, in turn, open the filling valve, as shown in FIGS. 16A and B, (ii) opening the closure of the filling probe after the probe depresses and opens the filling valve to inject or otherwise dispense the substance through the open filling probe and valve and into the pouch chamber, as shown in FIGS. 16C and D, (iii) closing of the filling probe after filling the substance into the pouch chamber, and then (iv) withdrawing the closed filling probe away from the filling valve to, in turn, allow the spring to bias the filling valve back into its normally closed position to seal the filled substance in the pouch chamber; The filled substance may be dispensed from the pouch chamber through the filling valve by sterile connecting a male connector of the type shown in FIGS. 17A through E that includes a normally-closed probe connectable in fluid communication with the filling valve.
Figure 16A:
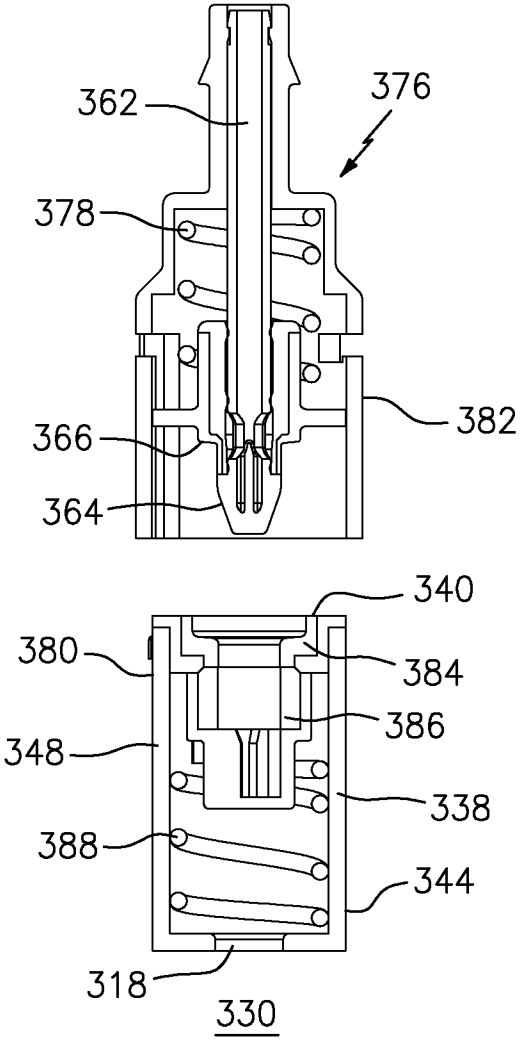
Figure 16D:
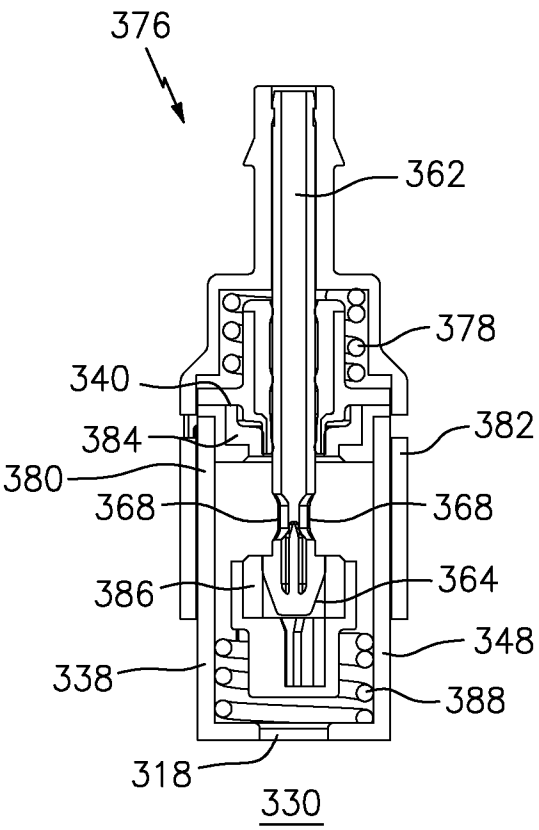
Figure 16C:
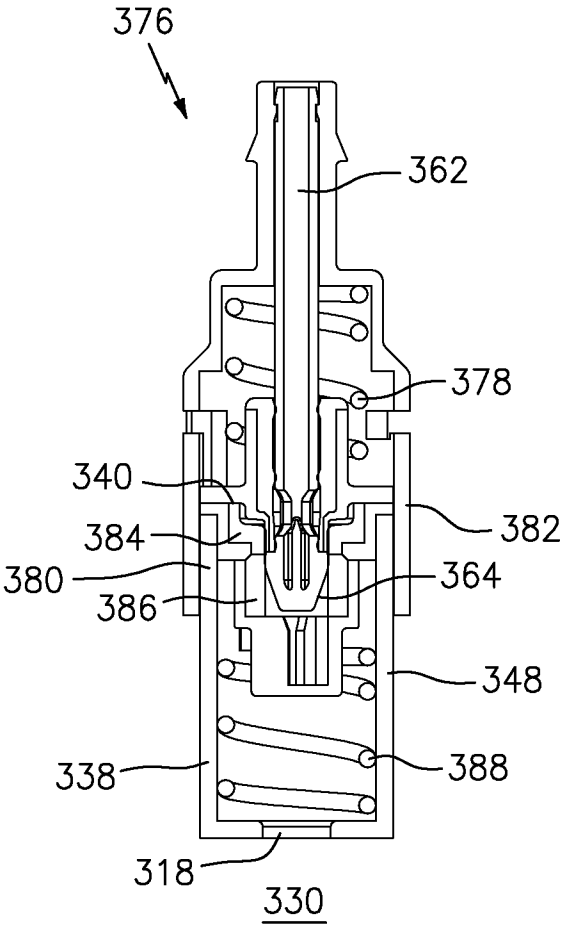

As shown in FIGS. 16A and B, the filling head 376 is moved toward and into engagement with the fitting 348 so that the male housing 380 of the fitting is slidably received within the female housing 382 of the filling head 376, and the filling probe tip 364 is in turn received through the aperture in the valve seat 384. As shown in FIG. 16C, further movement of the filling head 376 toward the fitting 348 (or vice versa) presses the filling probe tip 364 into engagement with the valve 386 to, in turn, depress the valve against the bias of the valve spring 388 and away from the valve seat 384 to open the valve. As shown in FIGS. 16C and D, upon passage of the probe tip 364 through the valve seat 384 and into engagement with the valve 386, a laterally extending flange of the probe closure 366 is fixed against the fitting 384 to prevent further movement of the closure. As shown in FIGS. 16C and D, this allows further movement of the probe tip 364 relative to the closure 362 and against the valve 386 to further depress the valve against the bias of the valve spring 388 and, in turn, move the eyes 366 of the probe into sterile fluid communication with the pouch chamber 330 through the axially-spaced opening between the depressed valve 386 and the valve seat 384. In the position shown in FIG. 16D, fluid is permitted to flow from the probe assembly 362, through the open eyes 368, through the axially-spaced opening between the depressed valve 386 and the valve seat 384, and into the pouch chamber 330. Also in this position, fluid is permitted to flow from the pouch chamber 330 in the opposite direction to dispense or otherwise withdraw fluid from the pouch chamber, such as by turning the pouch upside down so that the fitting 348 is located at the bottom of the pouch. Alternatively, a pump (not shown) may be used to withdraw or dispense fluid, such as a peristaltic pump engaged with a flexible outlet tube or conduit. The filling head 376 is disconnected from the fitting 348 by reversing the foregoing steps. When the probe tip 364 is withdrawn into the valve seat 384, (i) the valve spring 388 biases the valve 386 into engagement with the valve seat 384 to close the valve 340 and seal the pouch chamber 330 from the ambient atmosphere, and (ii) the spring 378 in the filling head 376 drives the closure 362 into engagement with the probe tip 364 to form a fluid-tight seal therebetween and seal the probe eyes 368 and other internal surfaces of the probe from the ambient atmosphere.

In FIGS. 17A through E, another embodiment of a fitting that may be used in the pouches embodying the present invention is indicated generally by the reference numeral 448. The fitting 448, the fitment that it is part of, and the pouch to which it is attached, are the same and/or similar in certain respects to the fittings, fitments and pouches described above, and therefore like reference numerals preceded by the numeral "4", or preceded by the numeral "4" instead of the numerals "1," "2" or "3," are used to indicate like elements. One difference of this embodiment is that the fitting 448 forms a female connector that is engageable with a male connector 476 to form a sterile connection to allow a sterile flow of fluid into and/or out of the pouch chamber 440.

The female connector 448 includes a spring-biased filling valve 440 that is engageable by a normally-closed filling probe 462 of the male connector 476 to sterile fill substance into the chamber 430 of the pouch 410 (not shown) or dispense or otherwise withdraw substance from the pouch chamber 430. The male connector 476 includes a normally-closed probe assembly 462 including a probe defining a probe tip 464, a probe closure 466, and probe eyes or apertures 468. A coil spring 478 normally biases the closure 466 toward and into engagement with the tip 464 of the probe to seal the probe eyes 468 from ambient atmosphere, and thereby maintain the probe eyes 468 and other interior surfaces of the probe sterile. The male connector 476 includes a female connector housing 482, and the female connector 448 defines a male connector housing 480 that is slidably received within the female connector housing 482 to connect the male connector and its normally-closed probe assembly 462 to the female connector and its valve 440. In the female connector 448, the valve 440 includes a valve seat 484, a valve 486, and a spring 488 that normally biases the valve 486 into engagement with the valve seat to form a fluid-tight seal that seals the chamber 430 of the pouch from ambient atmosphere. The male connector 476 is connected to the female connector 448 to sterile fill a substance into the pouch chamber and/or dispense or otherwise withdraw a substance therefrom, as hereinafter set forth.

Figure 17A:
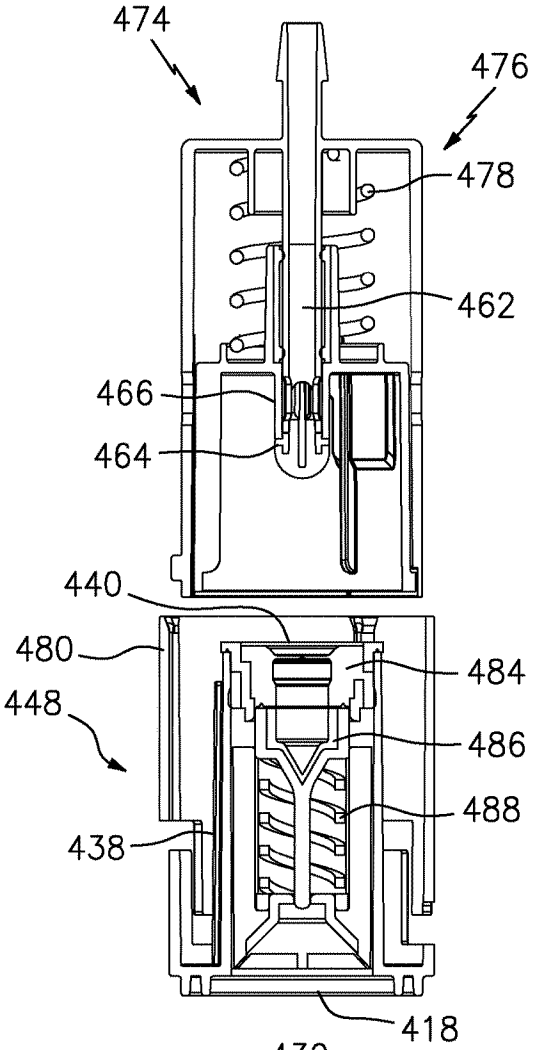
FIGS. 17A through E are a series of progressive, partial, cross-sectional views of a fitment including a spring-biased valve forming a female connector of a sterile connector that is depressible by the normally-closed probe of a corresponding male connector to allow fluid to flow into and/or out of the pouch, by (i) depressing the valve against the bias of the spring with the closed probe to, in turn, open the valve, as shown in FIGS. 17A through C, (ii) opening the closure of the probe after the probe depresses and opens the valve to place the male and female connectors in sterile fluid communication with each other through the open probe and valve, as shown in FIG. 17D, (iii) closing the probe after allowing the sterile flow of fluid into and/or out of the pouch chamber, as shown in FIG. 17E, and then (iv) withdrawing the closed probe away from the valve to, in turn, allow the spring to bias the valve back into its normally closed position to seal the pouch chamber.
Figure 17B:
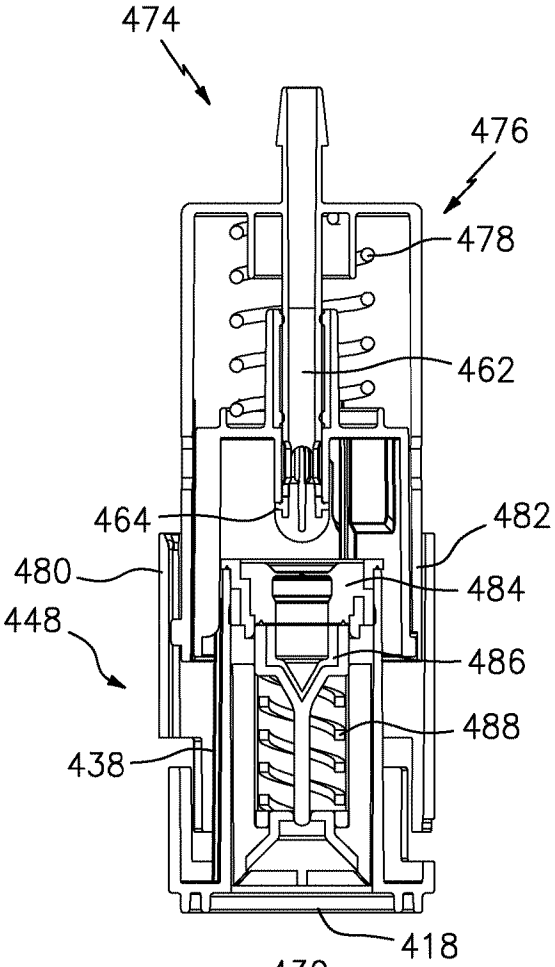
Figure 17C:
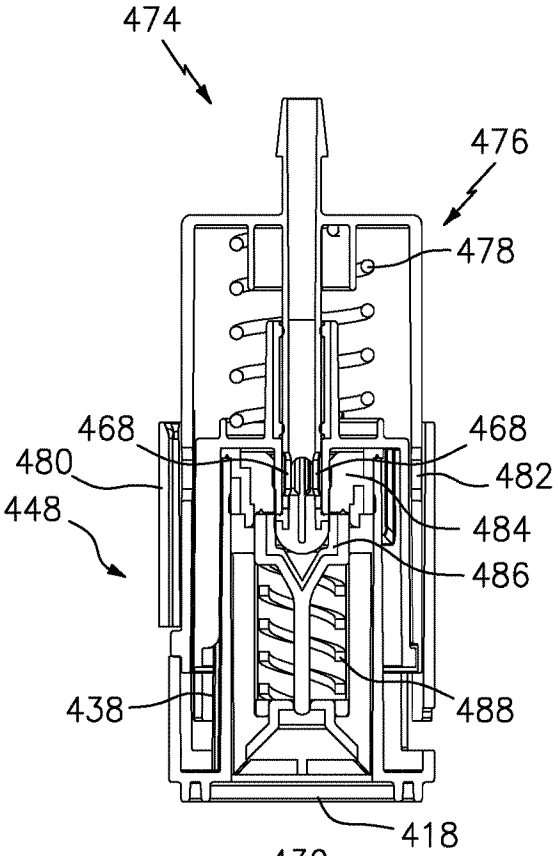
Figure 17E:
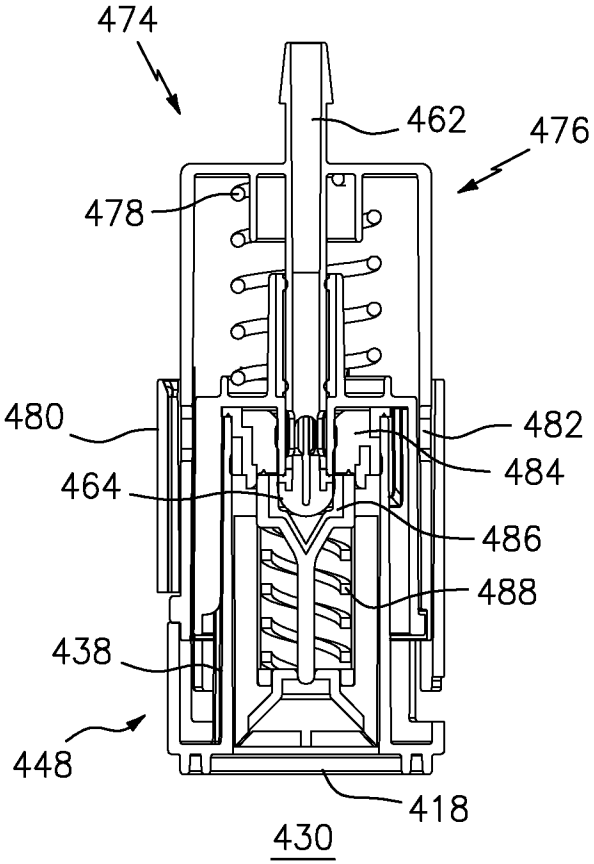
Figure 17D:
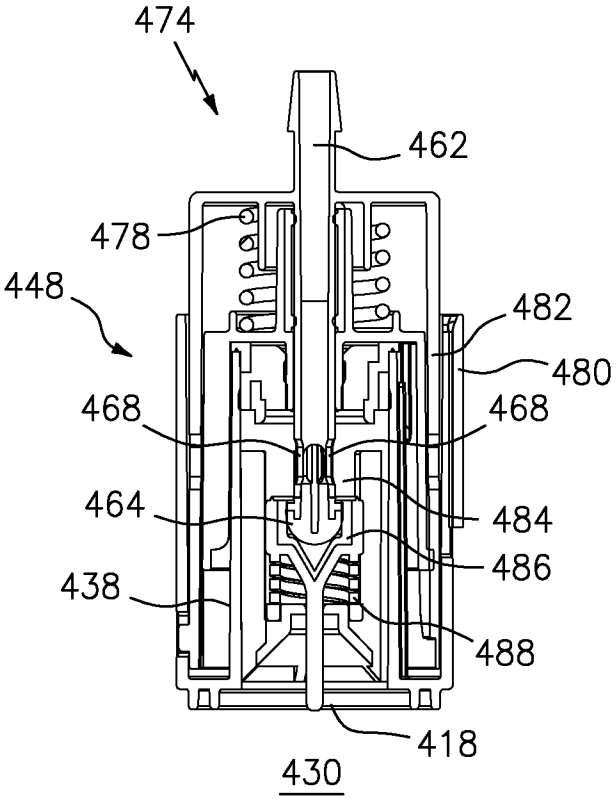

As shown in FIGS. 17A and B, the male connector 476 is moved toward and into engagement with the female connector 448 so that the male connector housing 480 of the female connector is slidably received within the female connector housing 482 of the male connector 476, and the filling probe tip 464 is in turn received through the aperture in the valve seat 484. As shown in FIG. 17C, further movement of the male connector 476 toward the female connector 448 (or vice versa) presses the probe tip 464 into engagement with the valve 486 to, in turn, depress the valve against the bias of the valve spring 488 and away from the valve seat 484 to open the valve. As shown in FIGS. 17C and D, upon passage of the probe tip 464 through the valve seat 484 and into engagement with the valve 486, a laterally extending flange of the probe closure 466 is fixed against a distal end of the boss 438 of the female connector to prevent further movement of the closure. As shown in FIGS. 17C and D, this allows further movement of the probe tip 464 relative to the closure 462 and against the valve 486 to further depress the valve against the bias of the valve spring 488 and, in turn, move the eyes 466 of the probe into sterile fluid communication with the pouch chamber 430 through the axially-spaced opening between the depressed valve 486 and the valve seat 484. In the position shown in FIG. 17D, fluid is permitted to flow from the probe assembly 462, through the open eyes 468, through the axially-spaced opening between the depressed valve 486 and the valve seat 484, and into the pouch chamber 430 to fill the pouch chamber. Also in this position, fluid is permitted to flow from the pouch chamber 430 in the opposite direction to dispense or otherwise withdraw fluid from the pouch chamber, such as by turning the pouch upside down so that the female connector 448 is located at the bottom of the pouch 410. The male connector 476 is disconnected from the female connector 448 by reversing the foregoing steps. As shown in FIG. 17E, when the probe tip 464 is withdrawn toward and into the valve seat 484, (i) the valve spring 488 biases the valve 486 into engagement with the valve seat 484 to close the valve 440 and seal the pouch chamber 430 from the ambient atmosphere, and (ii) the spring 478 in the male connector 476 drives the closure 462 into engagement with the probe tip 464 to form a fluid-tight seal therebetween and seal the probe eyes 468 and other internal surfaces of the probe from the ambient atmosphere.

Figure 18A:
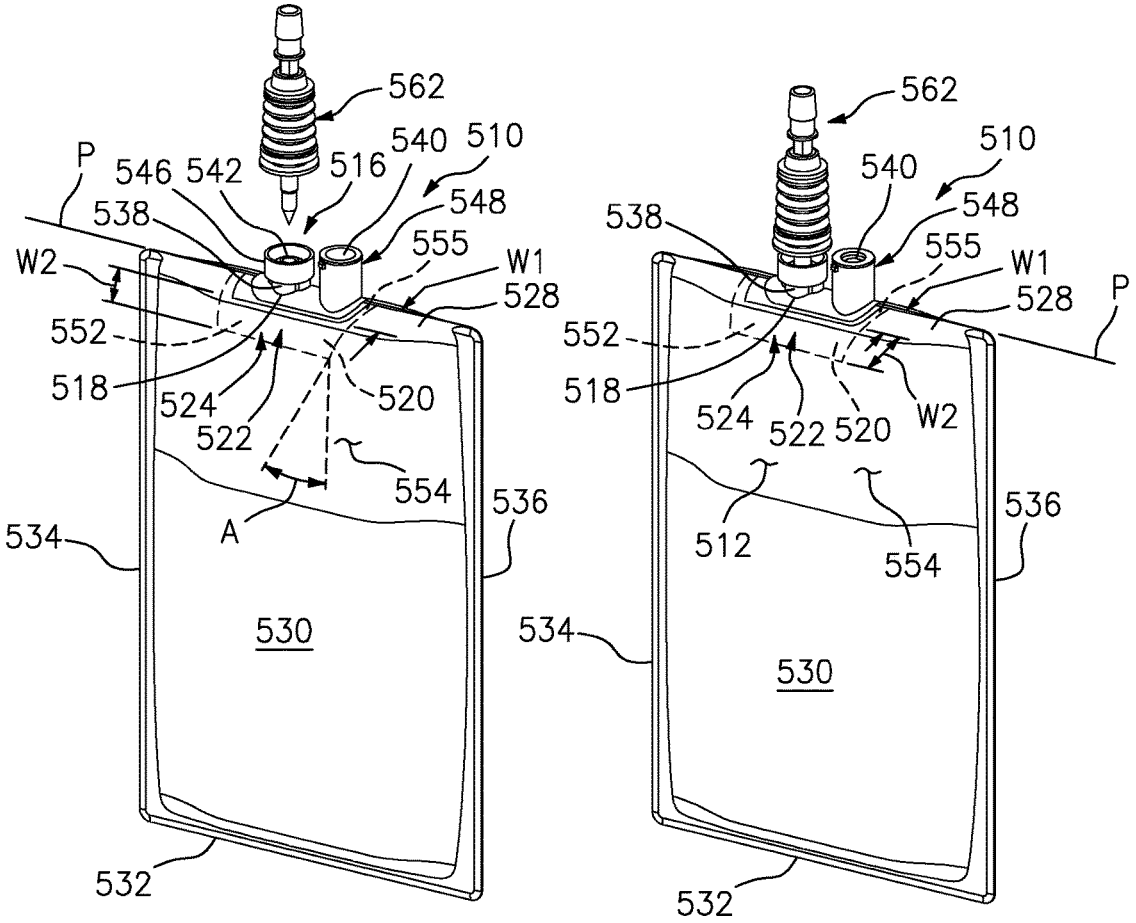
FIGS. 18A and B and 19A and B are a series of perspective views of another embodiment of a pouch comprising a single fitment including (i) a first fitting including a penetrable and resealable septum, which as shown in FIGS. 18A and B, is penetrable by a normally-closed filling needle to sterile fill a substance through the needle and into the chamber, and (ii) a second fitting including a spring-biased valve forming a female connector of a sterile connector, which as shown in FIGS. 19A and B, is depressible by the normally-closed probe of a corresponding male connector to dispense the sterile filled substance from the chamber.
Figure 18B:
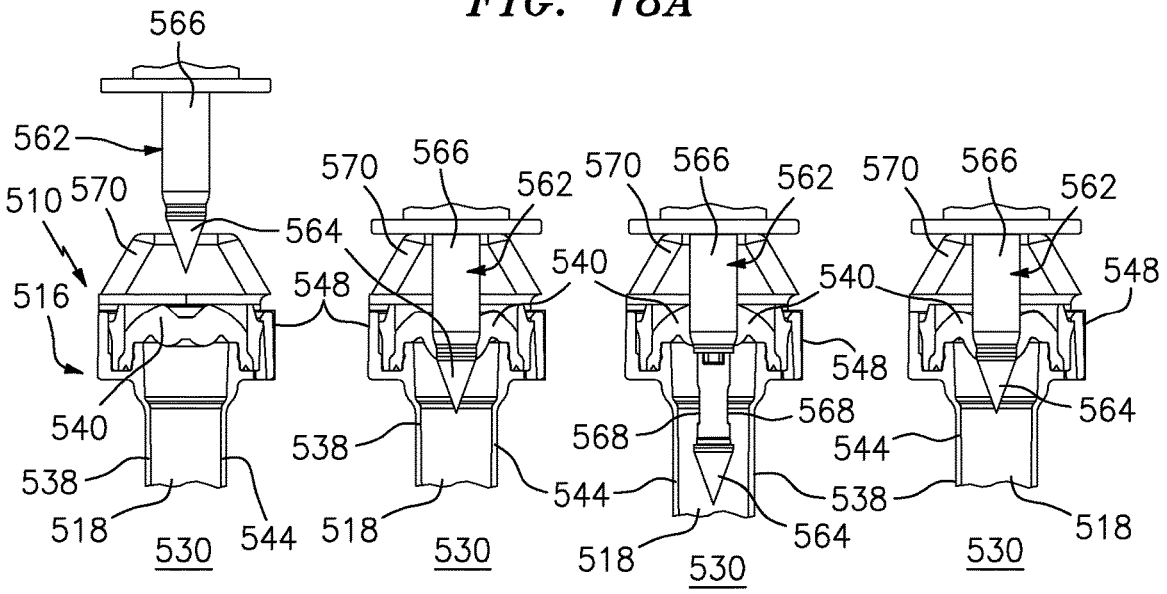
Figure 19A:
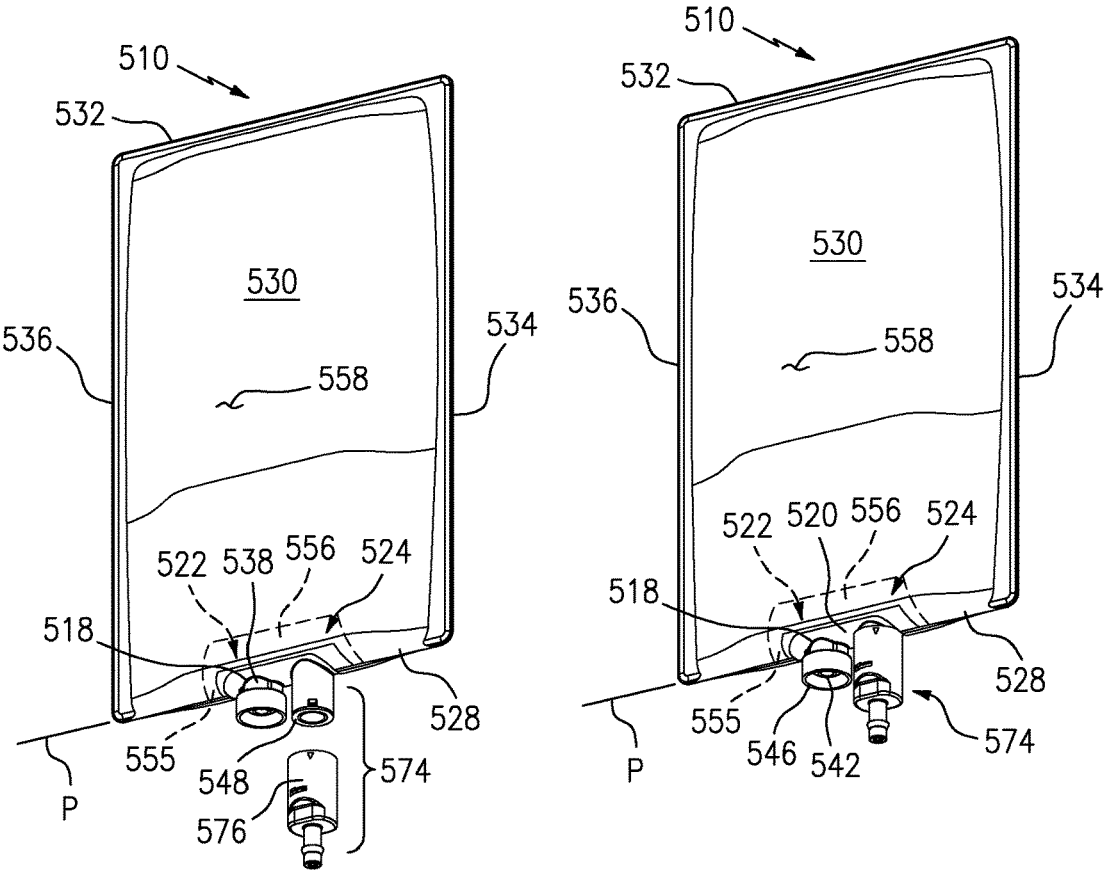
Figure 19B:
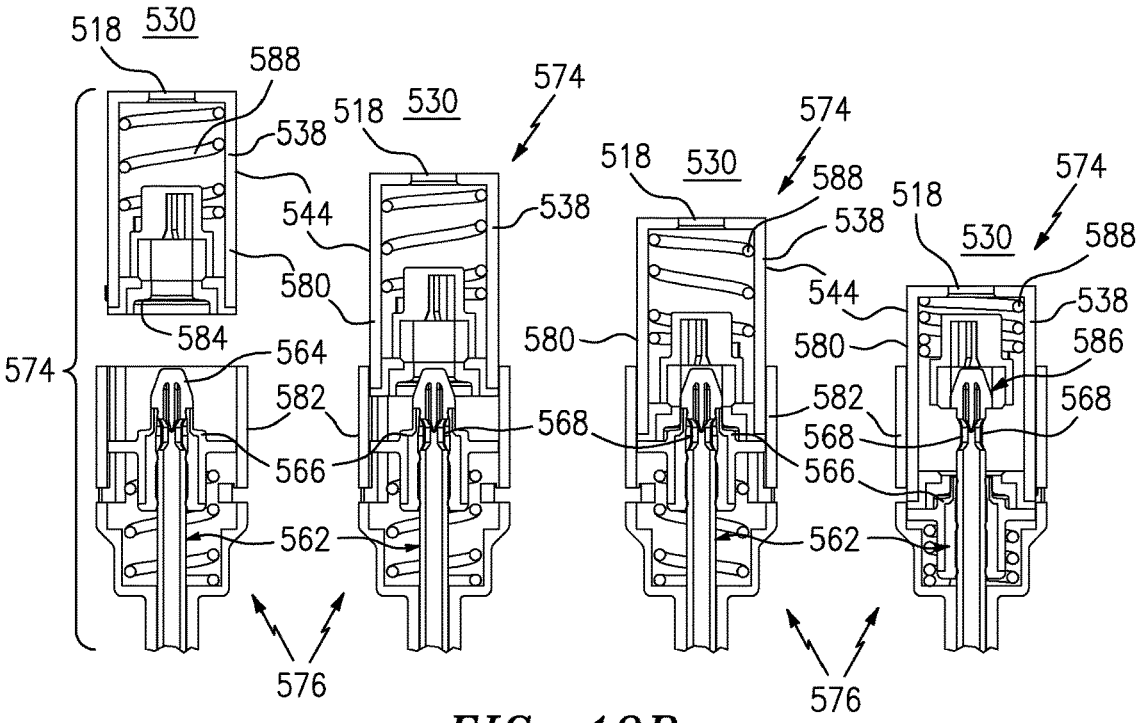

In FIGS. 18A and B and 19A and B, another embodiment of a pouch in accordance with the present invention is indicated generally by the reference numeral 510. The pouch 510, fitment 516 and/or fittings 546 and 548 are the same or substantially the same as one or more of the corresponding components described in connection with the embodiments above, and therefore like reference numerals preceded by the numeral "5", or preceded by the numeral "5" instead of the numerals "1", "2", "3" or "4", are used to indicate like elements. The pouch 510 comprises a double fitment 516 including (i) a first fitting 546 including a penetrable and resealable septum 542, which as shown in FIGS. 18A and B, is penetrable by a normally-closed filling needle assembly 562 to sterile fill a substance through the needle and into the pouch chamber 530, and (ii) a second fitting 548 in the form of a female connector including a spring-biased valve 540, which as shown in FIGS. 19A and B, is depressible by the normally-closed probe of a corresponding male connector 576 to dispense the sterile filled substance from the pouch chamber 530. The fitting 546 and its septum 542 preferably are the same in all material respects as the fittings with septa described above with reference to FIGS. 6 through 15. In addition, the pouch 510 is sterile filled with a normally-closed filling needle assembly 562 through the septum 542 as shown in the progressive views of FIG. 18B in the same manner as described above in connection with FIGS. 14A through D. On the other hand, with reference to FIGS. 19A and B, the female connector 548 and the male connector 576 are the same as the female and male connectors, respectively, described above in connection with FIGS. 17A through E, and the fluid or other substance is dispensed or otherwise withdrawn from the pouch chamber 530 through the sterile connector 574 in the same manner as described above in connection with FIGS. 17A through 17E.

As shown in FIGS. 18A and 19A, the fold in the film 512 forming the marginal edge portion 528 defines a fold plane "P," the first side 554 of the pouch is transverse to the fold plane P, and the second side 558 opposite the first side also is transverse to the fold plane P. In the illustrated embodiments, the first and second sides 554 and 558, respectively, of the pouch are oriented approximately perpendicular to the fold plane P. However, as may be recognized by those of ordinary skill in the pertinent art based on the teachings herein, this angle is exemplary and may be changed as desired or otherwise required. The base 520 of the fitment defines a mid-portion 555, a first side 552 located on one side of the mid-portion, and a second side 556 located on an opposite side of the mid-portion relative to the first side. In the illustrated embodiment, both the first side 552 and the second side 556 of the base 520 are transverse to the fold plane P, and are engaged with the first side 554 and the second side 558 of the pouch, respectively, in the overlapping region 522 and are sealed thereto. The mid-portion 555, on the other hand, extends substantially along the fold plane P, is engaged with, and is sealed to the fold 528 of the pouch in the overlapping region 522. As indicated above, the mid-portion 555 of the base 520 defines a first width "W1", the first and second transverse sides 552 and 556, respectively, of the base each define a second width "W2" that is at least about 1½ times the first width W1, is preferably at least about 2 times the first width W1, and is even more preferably at least about 3 times the first width W1. As shown typically in broken lines in FIG. 18, the first and second transverse sides 552 and 556, respectively, each are (i) oriented at an acute angle "A" relative to a normal to the fold plane P, and (ii) oriented at another acute angle with respect to the fold plane P, which as described above, is preferably within the range of greater than about 45° to less than about 90°. However, as may be recognized by those of ordinary skill in the pertinent art based on the teachings herein, these widths and angles are only exemplary, and may be changed as desired or otherwise required.

Figure 20:
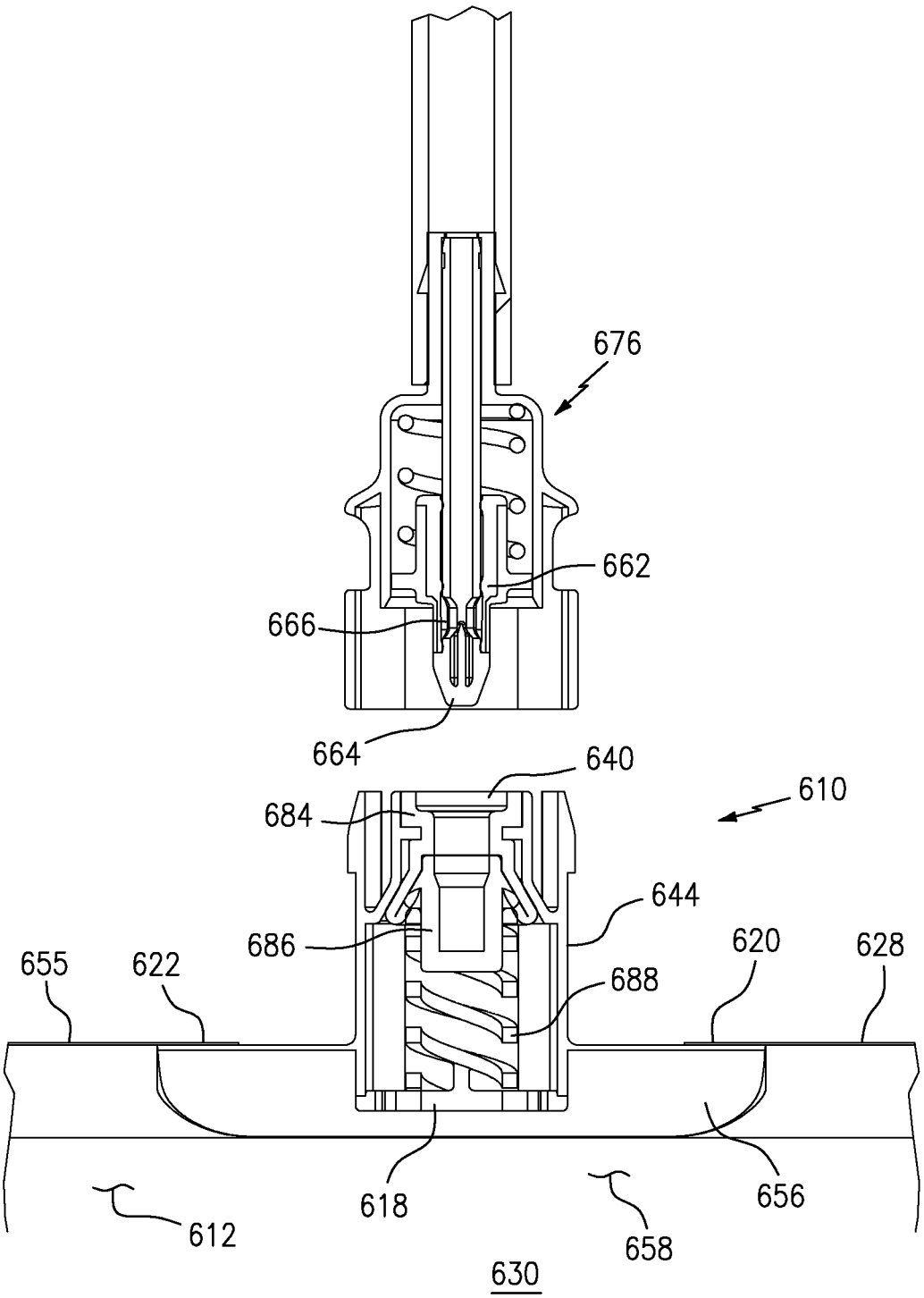
FIGS. 20 through 22 are a series of progressive, partial, cross-sectional views of another embodiment of a pouch including a single fitment with a spring-biased valve that is engageable by a normally-closed probe to fill a substance into and/or dispense a substance from the chamber of the pouch, by (i) depressing the valve against the bias of the spring with the closed probe to, in turn, open the valve, as shown in FIGS. 20 and 21, (ii) opening the closure of the probe after the probe depresses and opens the valve to allow the sterile flow of substance through the open probe and valve, as shown in FIG. 22, (iii) closing of the probe, and then (iv) withdrawing the closed probe away from the valve to, in turn, allow the spring to bias the valve back into its normally closed position to seal the chamber.
Figure 21:
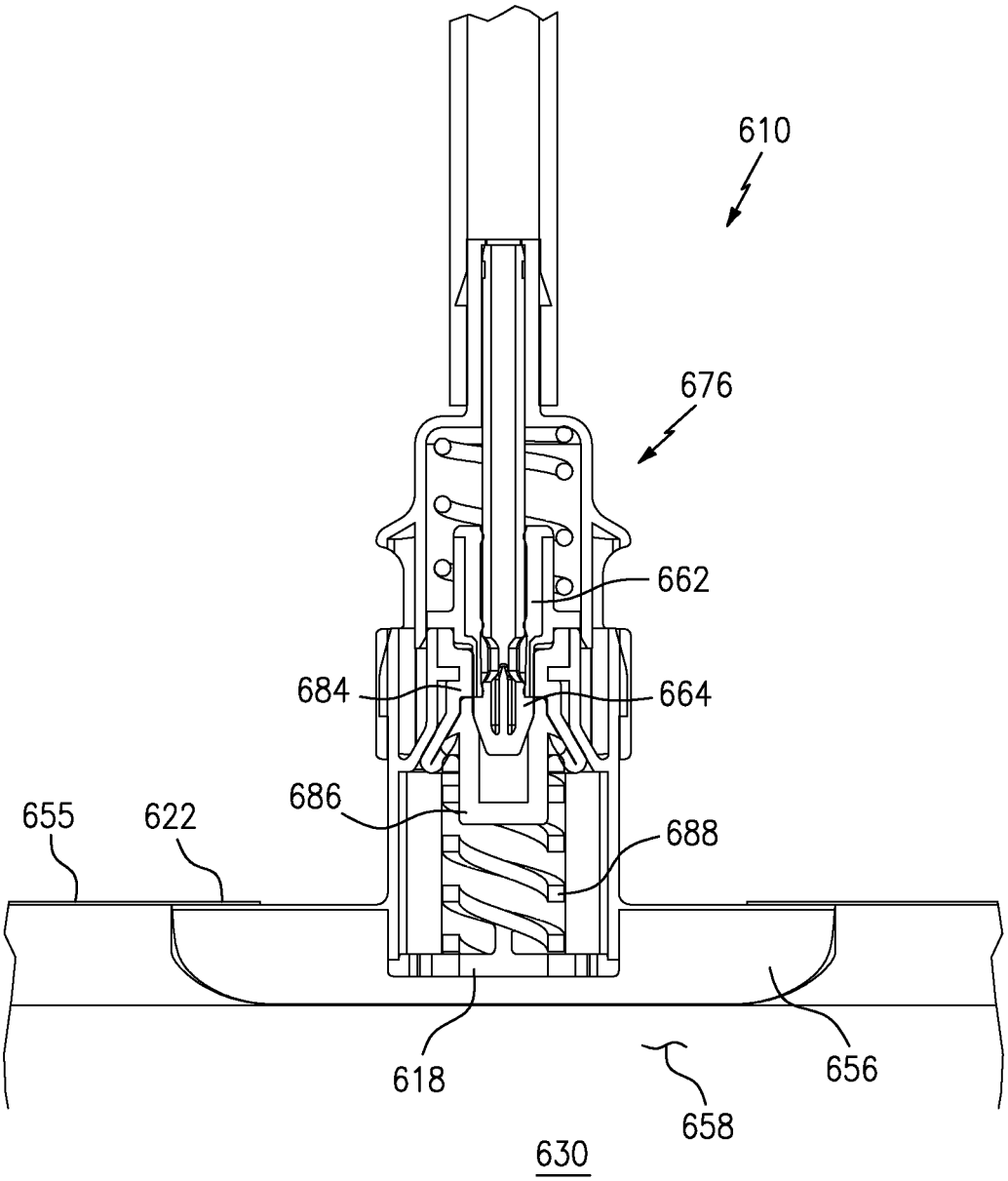
Figure 22:
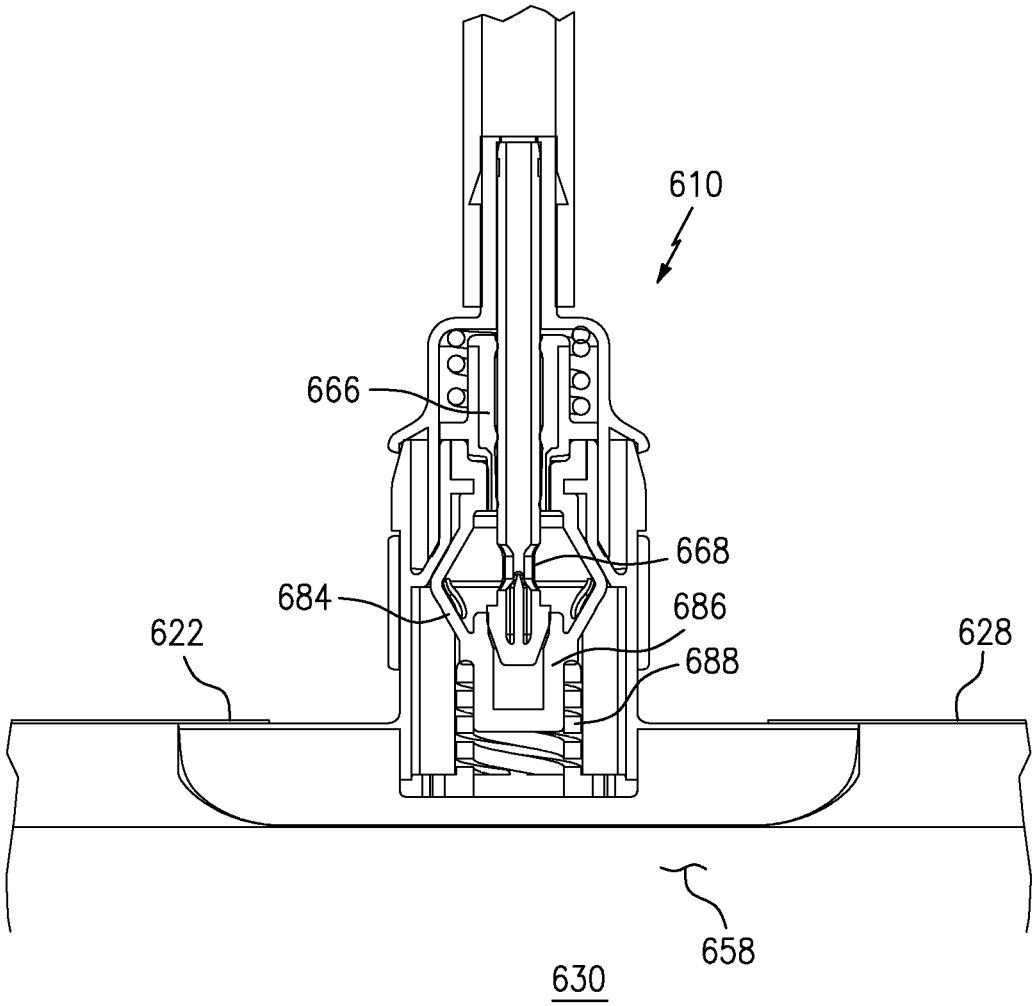

In FIGS. 20 through 22, another embodiment of a pouch in accordance with the present invention is indicated generally by the reference numeral 610. The pouch 610, fitment 616 and/or fitting 648 are the same or substantially the same as one or more of the corresponding components described in connection with the embodiments above, and therefore like reference numerals preceded by the numeral "6", or preceded by the numeral "6" instead of the numerals "1", "2", "3", "4" or "5", respectively, are used to indicate like elements. The pouch 610 includes a single fitment 616 with a spring-biased valve assembly 640 that is engageable by a normally-closed probe assembly 662 to fill a substance into and/or dispense a substance from the chamber 630 of the pouch 610. In the illustrated embodiment, the spring is a coil spring, and therefore the connector is designated "CSC" for "coil spring connector", and this version of the pouch is designated "Taco-CSC" based on the shape of the fitment base and type of connector. As can be seen, the fitment base has the shape of a taco, i.e., the base of the fitment is approximately "taco" shaped (or u-shaped in cross section), defining a mid-portion at the fold plane P, a first side transverse to the mid-portion and fold plane, and a second opposing side transverse to the mid-portion and fold plane, wherein each of the mid-portion, and first and second sides, is engaged with and sealed to the film in the overlapping region. The filling head 676 and its normally-closed probe assembly 662 is the same in all material respects as the filling head 376 and normally-closed probe assembly 362 described above in connection with FIGS. 16A through D, and/or the corresponding components described in connection with FIGS. 17A through E. Similarly, the fitting 648 and its valve assembly 640 are the same as the fitting and valve assembly described above in connection with FIGS. 16A through E and/or FIGS. 17A through E. The sterile connection is made to fill into or dispense/withdraw from the pouch chamber 630 as follows: (i) by depressing the valve 686 against the bias of the valve spring 688 with the closed probe 662 to, in turn, open the valve, as shown in FIGS. 20 and 21, and (ii) by fixing the closure 666 of the probe, further moving the probe tip 664 to open the valve and, in turn, exposing the eyes 666 of the probe to thereby allow the sterile flow of substance through the open probe and valve, as shown in FIG. 22.

Figures 23A, 23B, 23C, 23D, 23E:
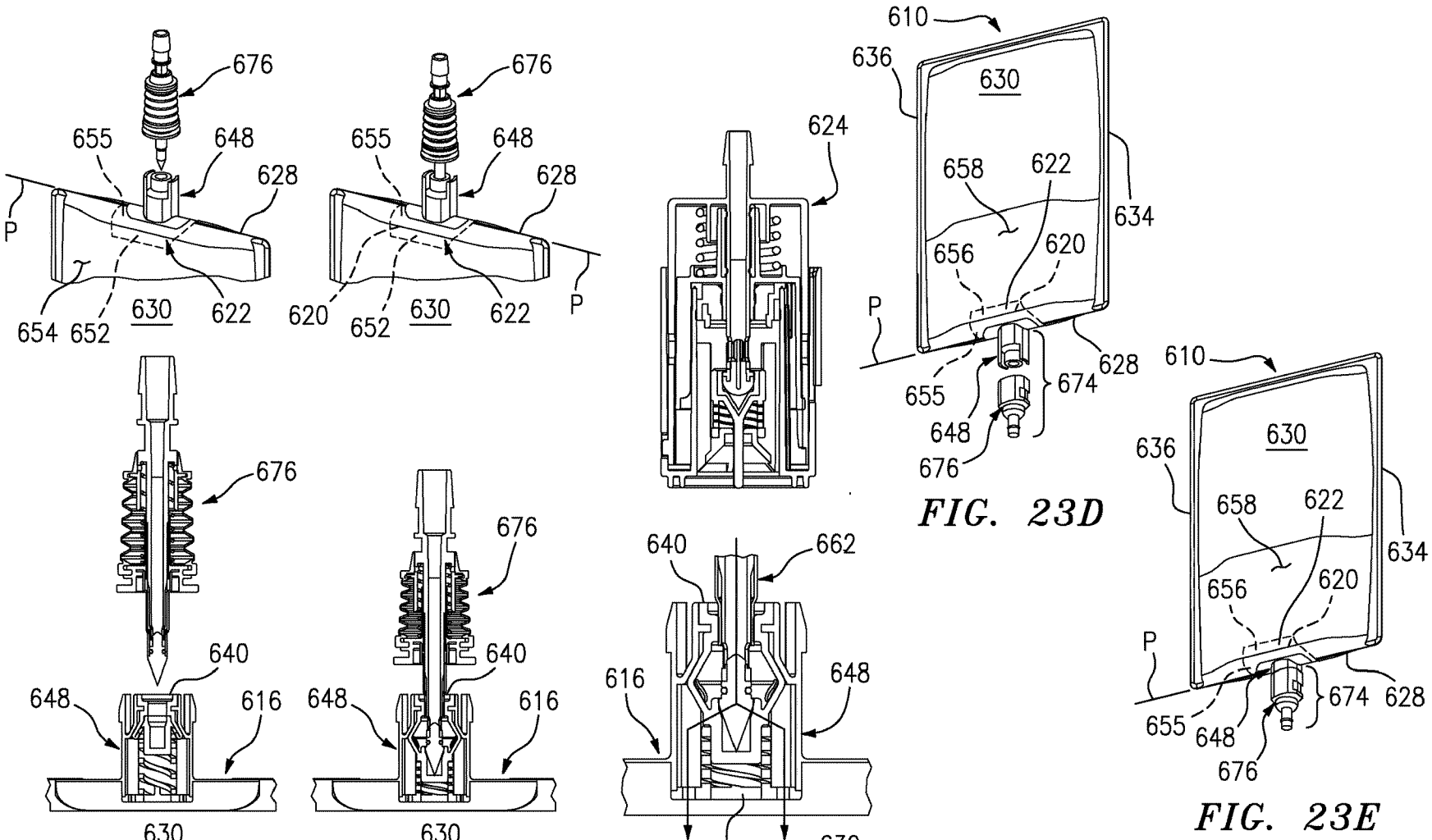
FIGS. 23A through E are a series of progressive views of the pouch of FIGS. 20 through 22 showing (i) in FIG. 23A, perspective and cross-sectional views of the normally-closed filling probe spaced away from the normally-closed valve; (ii) in FIG. 23B, perspective and cross-sectional views of the filling probe engaged and in fluid communication with the valve to sterile fill a substance from the filling probe, through the valve and into the chamber of the pouch; (iii) in FIG. 23C, cross-sectional views showing in the lower view the filling probe filling substance through the valve and into the pouch chamber, and showing in the upper view, the male connector probe engaging the female connector valve to allow the filled substance to flow out of the chamber and through the sterile connector; (iv) in FIG. 23D, a perspective view of the pouch and male connector of FIG. 23C prior to connection of the male connector to the female connector of the pouch; and (v) in FIG. 23E, a perspective view of the pouch and male connector after connection of the male connector to the female connector of the pouch to dispense the substance from the pouch through the sterile connection.

In FIGS. 23 A through E, the pouch 610 of FIGS. 20 through 22 is shown progressively undergoing sterile filling and dispensing as follows: (i) in FIG. 23A, the normally-closed filling head 676 is spaced away from the normally-closed valve 640; (ii) in FIG. 23B, the filling head 676 and its filling probe 662 are engaged and in fluid communication with the valve 640 to sterile fill a substance from the filling probe 662, through the valve 640 and into the chamber 630 of the pouch; As can be seen, the probe undergoes a "wiping" effect through insertion into and engagement with the valve to wipe the probe of any germs or contaminants, and facilitate the formation of a sterile connection therebetween; (iii) in the lower view of FIG. 23C, the filling probe 662 is filling substance through the open valve 640 and into the pouch chamber 630; (iv) in the upper view of FIG. 23C, the male connector probe 662 of the male connector is connected to, and engaged with the female connector valve 640 to allow the filled substance to flow out of the chamber and through the sterile connector; (v) in FIG. 23D, the pouch 610 and male connector 676 of FIG. 23C is spaced away from, and ready for connection to the female connector 648 of the pouch 610; and (vi) in FIG. 23E, male connector 676 is sterile connected to the female connector 648 of the pouch to dispense the substance from the pouch chamber 630 through the sterile connection and into a tube (not shown) connected to the outlet of the sterile connector.

As may be recognized by those of ordinary skill in the pertinent art based on the teachings herein, numerous changes, modifications and improvements may be made to the above-described and other embodiments of the present invention without departing from the scope of the invention as defined in the appended claims. For example, any of numerous different materials may be employed to form the components of the pouch or other device embodying the invention, such as the materials of the film and fitments attached thereto. For example, the film or pouch material may be made of any of numerous different materials or films that are currently known, or that later become known, including without limitation laminated films or other multi-layer films. Further, the pouch or other device may define any of numerous different shapes or configurations, including pouches or other devices with plural chambers and/or plural fitments attached thereto. Still further, the fitments may define any of numerous different configurations that are currently known, or that later become known, for filling substances into the pouch or other device, include sterile or aseptic filling, and/or for dispensing or otherwise withdrawing substance from the pouch or other device, or chamber(s) thereof. Accordingly, this detailed description of currently preferred embodiments is to be taken in an illustrative, as opposed to a limiting sense.

What is claimed is:

1. A pouch comprising:

a film including a fold defining a fold plane and a first marginal edge portion of the pouch, a first side transverse to the fold plane, a second side opposite the first side and transverse to the fold plane, and an aperture in the film; and a fitment including a port and a base defining a mid-portion engaging the fold at the fold plane, a first side located on one side of the mid-portion, and a second side located on an opposite side of the mid-portion relative to the first side, wherein (i) one or more of the first and second sides of the base is transverse to the fold plane and engaged with the first or second side of the film, respectively, (ii) one or more of the base or film overlaps the other and defines an overlapping region, and (iii) one or more of the base or film is sealed to the other within the overlapping region, defining a fluid-tight seal between the base and film that extends about the port and a perimeter of the aperture.

2. A pouch as defined in claim 1, wherein the first side of the base is located on one side of and is transverse to the fold plane, and is engaged with the first side of the film, and the second side of the base is located on one side of and is transverse to the fold plane, and engaged with the second side of the film.

3. A pouch as defined in claim 2, wherein the mid-portion of the base defines a first width, the first and second sides of the base each define a respective width that is at least a second width, and the second width is at least 1½ times the first width.

4. A pouch as defined in claim 3, wherein the second width is at least 3 times the first width.

5. A pouch as defined in claim 2, wherein the mid-portion of the base intersects the fold plane and/or is substantially parallel to the fold plane.

6. A pouch as defined in claim 5, wherein the first and second sides of the base are each located on one side of the fold plane and oriented at a respective acute angle relative to the fold plane.

7. A pouch as define in claim 6, wherein the acute angle is within a range of greater than 45° to less than 90°.

8. A pouch as defined in claim 1, wherein either (i) the film overlaps the mid-portion and first and second sides of the base in the overlapping region, or (ii) the mid-portion and first and second sides of the base overlap the film in the overlapping region.

9. A pouch as defined in claim 1, wherein the film includes a plurality of layers, at least one layer is different than at least one other layer, the base and film each include a common material in contact with the other in the overlapping region, and the base and the film are heat sealed to each other in the overlapping region.

10. A pouch as defined in claim 1, wherein the base and film are sealed to each other along a perimeter seal extending along a perimeter of the port.

11. A pouch as defined in claim 10, wherein the base and film are sealed to each other substantially throughout the overlapping region and define a single seal interface.

12. A pouch as defined in claim 10, wherein the base substantially surrounds the port, and the base and film are sealed to each other throughout a perimeter seal in the overlapping region that surrounds the port.

13. A pouch as defined in claim 1, wherein one or more of the base or film is sealed to the other throughout a continuous, uninterrupted, substantially contiguous, single interface between the base and film that extends annularly about the port.

14. A pouch as defined in claim 13, wherein the single interface seal extends across the mid-portion and each of the first and second sides of the base.

15. A pouch as defined in claim 1, wherein (i) a plurality of opposing edges of the film are sealed to each other to thereby define a sealed pouch including a chamber therein; (ii) the pouch defines a second marginal edge portion located on an opposite side of the pouch relative to the first marginal edge portion, a third marginal edge portion extending between the first and second marginal edge portions, and a fourth marginal edge portion located on an opposite side of the pouch relative to the third marginal edge portion; and (iii) the second, third and fourth marginal edge portions each are defined by sealed opposing marginal edge portions of the film.

16. A pouch as defined in claim 15, wherein the pouch is formed of a single sheet of film.

17. A pouch as defined in claim 1, wherein the fitment includes a boss defining the port and extending outwardly from the base.

18. A pouch as defined in claim 17, wherein the fitment includes one or more of (i) a penetrable and resealable septum or (ii) a sterile connector.

19. A pouch as defined in claim 18, wherein (i) the pouch defines a sealed chamber, (ii) the penetrable and resealable septum is penetrable by a needle or like injection member to fill the chamber of the pouch with a substance, and the resulting penetration aperture in the septum is resealable by the application of one or more of heat, radiation, chemical sealant, or mechanical seal thereto; and (iii) the sterile connector includes a penetrable septum that seals the chamber with respect to ambient atmosphere.

20. A pouch as defined in claim 1, wherein the pouch defines a sealed chamber, and the fitment includes a first fitting and a second fitting.

21. A pouch as defined in claim 20, wherein the first fitting defines a first port for filling a substance into the chamber, and the second fitting defines a second port for dispensing or extracting substance from the chamber.

22. A pouch as defined in claim 21, wherein the first fitting forms a fluid-tight seal between the chamber and ambient atmosphere and is configured to fill a substance through the first port and into the chamber, and the second port forms a fluid-tight seal between the chamber and ambient atmosphere.

23. A pouch as defined in claim 22, wherein (i) the first fitting includes one or more of a septum that is penetrable by a needle or like injection member, or a normally-closed filling valve, and (ii) the second port includes one or more of a septum that is penetrable by a needle or like injection member, or a normally-closed dispensing or withdrawal valve.

24. A pouch as defined in claim 23, wherein the dispensing or withdrawal valve includes a normally-closed valve (i) that is engageable by a device, such as a syringe, to open the valve and dispense, extract or otherwise withdraw substance from the pouch chamber, and (ii) is closed by disengaging the device from the valve to maintain a fluid-tight seal between the pouch chamber and ambient atmosphere.

25. A pouch as defined in claim 24, wherein (i) the valve includes a valve member, a valve seat, and a spring that normally biases the valve member into engagement with the valve seat to close the valve, (ii) the valve member is engageable by the device to move the valve member away from the valve seat against the bias of the spring to open the valve, and (iii) the spring biases the valve member into engagement with the valve seat to the close the valve when the device is disengaged from the valve member.

26. A pouch as defined in claim 25, wherein the spring is an elastic spring defining a least one aperture in fluid communication with the pouch chamber to allow fluid to flow from the pouch chamber through the aperture and open valve.

27. A pouch as defined in claim 1 in combination with an apparatus comprising:

a filling station including at least one filling or injection member coupled or connectible in fluid communication with a source of substance to be filled into the pouch, wherein at least one of the filling or injection member and the pouch is movable relative to the other within the filling station to penetrate a penetrable and resealable portion of the pouch with the filling or injection member, introduce substance through the filling or injection member and into the pouch, and withdraw the filling or injection member from the penetrable and resealable portion; and a resealing station configured to apply a hot-melt adhesive sealant onto an aperture formed in the penetrable and resealable portion during the filling of the pouch at the filling station and thereby reseal the aperture.

28. A pouch and apparatus combination as defined in claim 27, wherein the resealing station is configured to apply a metered amount of hot-melt adhesive onto the aperture.

29. A pouch as defined in claim 1, wherein:

the pouch defines a chamber containing a substance therein and sealed with respect to ambient atmosphere with a fluid-tight seal, and a penetrable portion in fluid communication with the chamber, the penetrable portion having a penetration aperture formed therein by penetration of a filling or injection member through the penetrable portion for introducing the substance into the chamber;

and a hot melt adhesive sealant covers or overlays the penetration aperture and, in turn, hermetically seals the penetration aperture and the substance in the chamber from the ambient atmosphere with a fluid-tight seal.

30. A pouch as defined in claim 1 wherein:

the pouch defines a chamber containing a substance therein and is sealed with respect to ambient atmosphere with a fluid-tight seal;

the port comprises a penetrable and resealable portion in fluid communication with the chamber, a penetration aperture within the penetrable and resealable portion formed by penetration of a needle or like injection member therethrough for filling the substance into the chamber, and a hot-melt adhesive sealant covering or overlying the penetration aperture and, in turn, sealing the penetration aperture from the ambient atmosphere with a fluid-tight seal; and the fitment further includes a second port including a penetrable portion in fluid communication with the chamber, wherein the penetrable portion defines a fluid-tight seal between the chamber and the ambient atmosphere and is penetrable by a needle or like injection member for removing substance from the chamber.

31. A pouch comprising:

a film including a fold defining a fold plane and forming a first marginal edge portion of the pouch; a first side of the pouch located on one side of the fold and transverse to the fold plane; a second side of the pouch opposite the first side of the pouch and transverse to the fold plane; and a chamber formed between the first and second sides of the pouch, and an aperture in the film; and a fitment including first means for one or more of introducing a substance into the chamber or withdrawing a substance from the chamber; second means for engaging the fold at the fold plane; third means located on one side of the second means for engaging the first side of the pouch; fourth means located on an opposite side of the second means relative to the third means and for engaging the second side of the pouch; and fifth means defining a base for forming a continuous, uninterrupted, single interface seal between the base and pouch that extends annularly about the first means and about a perimeter of the aperture.

32. A pouch as defined in claim 31, wherein the first means is a port, the second means is a mid-portion of a base of the fitment, the third means is one side of the base of the fitment located on one side of the mid-portion, the fourth means is another side of the base of the fitment located on an opposite side of the base relative to the third means, and the fifth means is a heat sealed, overlapping region of the film and base extending across the fold, the first side and second side of the pouch.

33. A pouch as defined in claim 32, wherein the first side of the base is located on one side of and is transverse to the fold plane, and is engaged with the first side of the pouch, and the second side of the base is located on one side of and is transverse to the fold plane, and engaged with the second side of the pouch.

34. A pouch as defined in claim 31, wherein the fitment includes (i) sixth means for sterile filling the pouch with a substance; and (ii) seventh means for connecting to the pouch in sterile fluid communication with the chamber and withdrawing or dispensing substance therefrom.

35. A pouch as defined in claim 34, wherein the sixth means (i) is a penetrable and resealable septum that is penetrable by a needle or like injection member to fill the chamber of the pouch with a substance, and a resulting penetration aperture in the septum is resealable by an application of one or more of heat, radiation, chemical sealant, or mechanical seal thereto, or (ii) is a filling valve including a valve member normally biased by a spring into engagement with a valve seat to close the valve, and engageable by a filling member to depress the valve member against the bias of the spring, open the valve, and introduce the substance from the filling member through the open valve; and the seventh means (i) is a sterile connector including a penetrable septum that seals the chamber with respect to ambient atmosphere, or (ii) is a sterile connector including a valve member normally biased by a spring into engagement with a valve seat to close the valve.

36. A method comprising the following steps:

(i) overlapping a mid-portion of a fitment base and a fold of a film with the other at a fold plane;

(ii) overlapping a first side of the fitment base located on a first side of the mid-portion thereof and a first side of the film with the other;

(iii) overlapping a second side of the fitment base located on a second side thereof and a second side of the film with the other, wherein at least one of the first or second sides of the base is transverse to the fold plane and is engaged with the first or second side of the film, respectively;

(iv) sealing a plurality of opposing marginal edge portions of the film and forming a sealed empty chamber therein;

(v) forming an aperture in the film; and (vi) forming a continuous, uninterrupted, single interface seal that extends between the fold and the mid-portion of the fitment base, extends between the first side of the fitment base and the first side of the film, extends between the second side of the fitment base and the second side of the film, extends about a perimeter of the aperture.

37. A method as defined in claim 36, wherein the first side of the base is transverse to the fold plane and is engaged with the first side of the film, and the second side of the base is transverse to the fold plane and is engaged with the second side of the film.

38. A method as defined in claim 36, further comprising (i) overlapping the film to the fitment base, or (ii) overlapping the fitment base to the film.

39. A method as defined in claim 38, further comprising heat sealing the film and fitment base to each other.

40. A method as defined in claim 36, further comprising (i) folding the film after sealing the film and fitment base to each other, or (ii) folding the film before sealing the film and fitment base to each other.

41. A method as defined in claim 36, further comprising (i) sealing the plurality of opposing marginal edge portions of the film and forming a sealed empty chamber therein prior to sealing the film and fitment base to each other, or (ii) sealing the plurality of opposing marginal edge portions of the film and forming a sealed empty chamber therein after sealing the film and fitment base to each other.

42. A method as defined in claim 36, further comprising attaching to the film a fitment including one or more of (i) a penetrable and resealable septum or (ii) a sterile connector.

43. A method as defined in claim 42, wherein the penetrable and resealable septum is penetrable by a needle or like injection member to fill the chamber of the pouch with a substance, and a resulting penetration aperture in the septum is resealable by an application of one or more of heat, radiation, chemical sealant, or mechanical seal thereto.

44. A method as defined in claim 36, further comprising molding the fitment with a plurality of sprouts, wherein at least one sprout is configured for filling a substance into the chamber and another sprout is configured for dispensing substance from the chamber.

45. A method as defined in claim 36, further comprising molding the fitment with a single sprout including a valve for one or more of filling a substance through the valve and into the chamber, or dispensing a substance through the valve and from the chamber.

46. A method as defined in claim 36, further comprising introducing a fluid sterilant into the interior of the chamber to sterilize the chamber.

47. A method as defined in claim 46, further comprising molding the fitment with a sprout including a penetrable and self-resealing septum, penetrating the septum with a needle or like injection member, introducing the fluid sterilant through the needle or like injection member and into the chamber, withdrawing the needle, and allowing the septum to reseal itself and retain fluid sterilant in the chamber for a period of time sufficient to sterilize the interior of the chamber.

48. A method as defined in claim 36, further comprising molding the fitment with a plurality of sprouts, wherein a first sprout includes a luer connector including a valve therein for connecting a syringe thereto and withdrawing substance from the chamber through the valve and into the syringe, and a second sprout is configured for filling substance into the chamber.

49. A method comprising the following steps:

(i) molding a fitment with a fitment base and a plurality of sprouts;

(ii) overlapping a mid-portion of the fitment base and a fold of a film with the other at a fold plane;

(iii) overlapping a first side of the fitment base located on a first side of the mid-portion thereof and a first side of the film with the other;

(iv) overlapping a second side of the fitment base located on a second side thereof and a second side of the film with the other, wherein at least one of the first or second sides of the base is transverse to the fold plane and is engaged with the first or second side of the film, respectively;

(v) sealing a plurality of opposing marginal edge portions of the film and forming a pouch defining a sealed empty chamber therein; and (vi) forming a continuous, uninterrupted, single interface seal that extends between the fold and the mid-portion of the fitment base, extends between the first side of the fitment base and the first side of the film, and extends between the second side of the fitment base and the second side of the film;

wherein a first of the plurality of sprouts includes a luer connector including a valve therein for connecting a syringe thereto and withdrawing substance from the chamber through the valve and into the syringe, and a second of the plurality of sprouts is configured for filling substance into the chamber.

50. A method as defined in claim 36, further comprising the following steps:

(i) penetrating a penetrable and resealable portion of the fitment base with a needle or other injection member;

(ii) introducing a substance through the needle or other injection member and into the sealed empty chamber;

(iii) withdrawing the needle or other injection member from the penetrable and resealable portion; and (iv) sealing a resulting penetration aperture in the penetrable and resealable portion with a fluid-tight seal by applying hot-melt adhesive sealant thereto.

51. A method as defined in claim 49, wherein the penetrable and resealable portion is in fluid communication with the chamber, and the sealing step seals the chamber with respect to ambient atmosphere with a fluid-tight seal.

52. A method as defined in claim 49, wherein the applying step comprises applying a metered amount of hot-melt adhesive onto the resulting penetration aperture in the penetrable and resealable portion.

* * * * *